US008783367B2

(12) United States Patent
Cronley et al.

(10) Patent No.: US 8,783,367 B2
(45) Date of Patent: Jul. 22, 2014

(54) LATERAL LINER TIE BACK SYSTEM AND METHOD

(75) Inventors: Gerald G. Cronley, Gretna, LA (US); Timothy T. Torrez, Aztec, NM (US)

(73) Assignee: Knight Information Systems, LLC, Lafayette, LA (US)

( * ) Notice: Subject to any disclaimer, the term of this patent is extended or adjusted under 35 U.S.C. 154(b) by 336 days.

(21) Appl. No.: 13/467,162

(22) Filed: May 9, 2012

(65) Prior Publication Data

US 2013/0299187 A1 Nov. 14, 2013

(51) Int. Cl.
*E21B 23/03* (2006.01)

(52) U.S. Cl.
USPC ..... 166/380; 166/208

(58) Field of Classification Search
USPC ..... 166/380, 50, 208
See application file for complete search history.

(56) References Cited

U.S. PATENT DOCUMENTS

| | | | | |
|---|---|---|---|---|
| 4,825,954 | A | 5/1989 | Baugh | |
| 5,435,392 | A | 7/1995 | Kennedy | |
| 5,477,925 | A | 12/1995 | Trahan et al. | |
| 5,944,108 | A * | 8/1999 | Baugh et al. | 166/313 |
| 6,279,659 | B1 | 8/2001 | Brunet | |
| 6,619,400 | B2 * | 9/2003 | Brunet | 166/313 |
| 7,231,980 | B2 | 6/2007 | Murray et al. | |
| 8,069,920 | B2 | 12/2011 | Cronley et al. | |
| 2010/0252257 | A1 | 10/2010 | Cronley et al. | |

OTHER PUBLICATIONS

PCT International Searching Authority/US, International Search Report and Written Opinion of the International Searching Authority, mailed Sep. 6, 2013, for PCT/US2013/040048, "Lateral Liner Tie Back System and Method."

* cited by examiner

*Primary Examiner* — William P Neuder
(74) *Attorney, Agent, or Firm* — Jones Walker LLP

(57) ABSTRACT

A lateral liner tie back system and method includes a base sub having a tapered upper end surface. The base sub may be positioned in a main bore at a window to a lateral bore. The tapered upper end surface of the base sub may direct a junction sub from the main bore partially into the lateral bore such that an end of an existing liner positioned within the lateral bore is disposed within a central bore of the junction sub. The system may also include a tie back sub that is lowered through the junction sub into the lateral bore. The tie back sub includes threads for engaging the end of the existing liner in the lateral bore. The lateral liner tie back system may selectively direct a tool that is lowered in the main bore into the lateral bore or prevent the tool from entering the lateral bore.

24 Claims, 24 Drawing Sheets

LATERAL LINER TIE BACK SYSTEM AND METHOD

DETAILED DESCRIPTION OF THE PREFERRED EMBODIMENTS

Due to miscalculations, liners placed in lateral well bores sometimes do not enclose the entire length of the lateral bore. For example, the top of the liner may be positioned at a certain distance below the window from the main bore. In this situation, the top portion of the lateral bore is under open hole conditions. Because of the risk of the top portion of the lateral bore collapsing, it is desirable to complete the existing liner in the lateral bore. This situation may arise in a system having a main bore with one lateral bore or in a system having two or more lateral bores. A lateral liner tie back system may be used to complete the existing liner in the lateral bore. Alternatively, a lateral liner tie back system may be used to selectively direct a tool being lowered in a main bore into a lateral bore or past the lateral bore.

Figure 1:
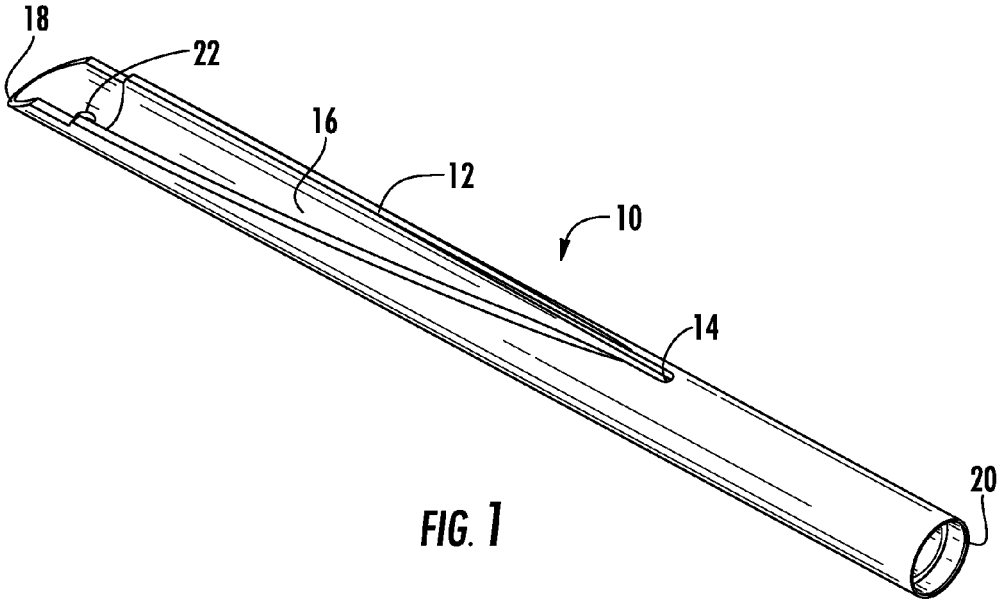
FIG. 1 is a perspective view of a base sub of a lateral liner tie back system.

With reference to FIG. 1, base sub 10 may have a generally tubular shape and may include tapered upper end surface 12 having apex 14. Central bore 16 may extend through base sub 10 from upper end 18 to lower end 20. Base sub 10 may also include bolt aperture 22 near upper end 18. In a preferred embodiment, base sub 10 may have an overall length of approximately 9 feet and an outer diameter of approximately 6 inches, central bore 16 may have a diameter of approximately 4.25 inches, and tapered upper end surface 12 may have a slope of approximately 3.2 degrees relative to an outer wall of base sub 10.

Figure 2:
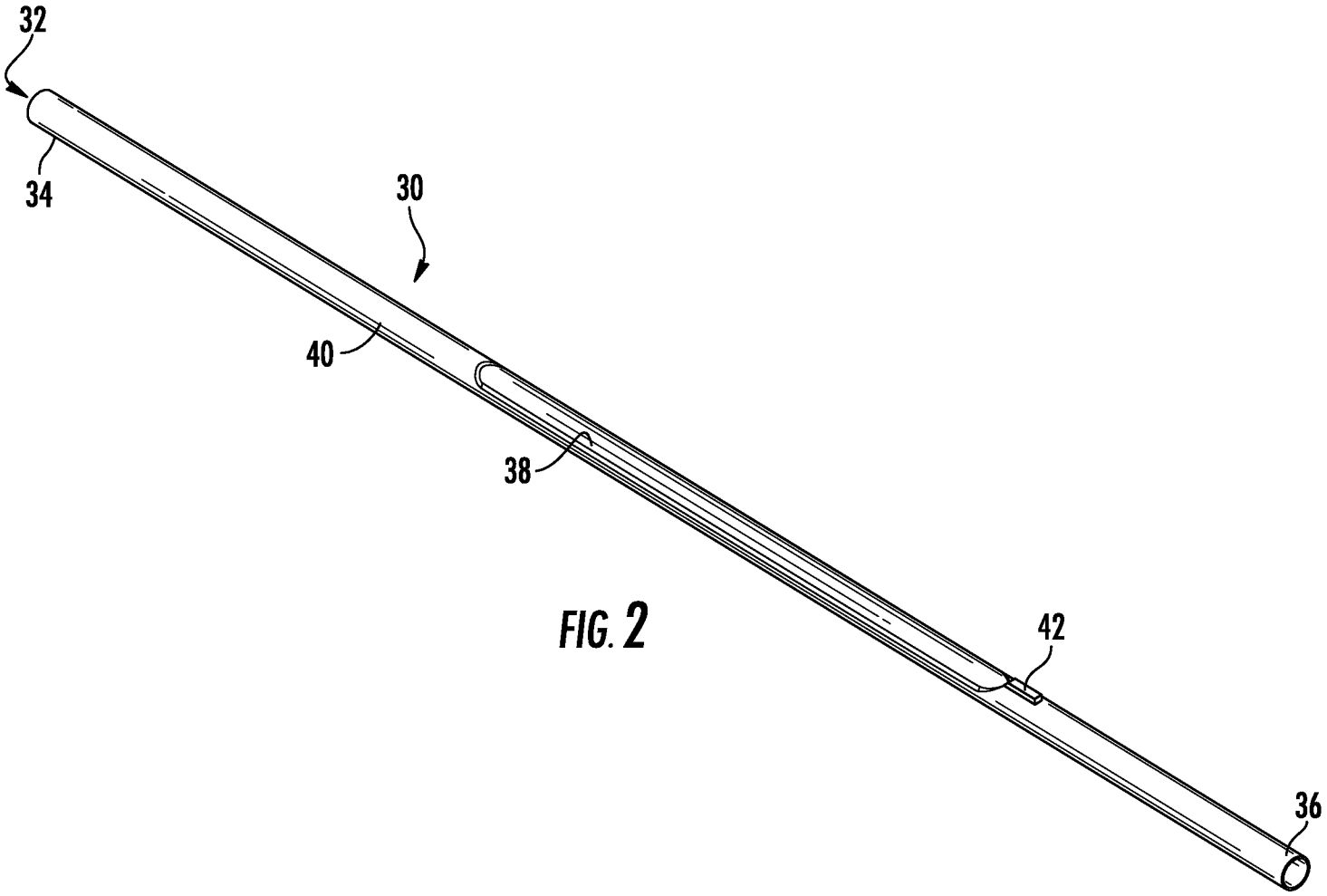
FIG. 2 is a perspective view of a junction sub of the system.

Referring now to FIG. 2, junction sub 30 may have a generally tubular shape and may include central bore 32 extending from upper end 34 to lower end 36. Junction sub 30 may also include opening 38 through outer wall 40, and key 42 affixed to outer wall 40 adjacent to a lower end of opening 38. Key 42 may be dimensioned to engage apex 14 of tapered upper end surface 12 on base sub 10 to properly align opening 38 with base sub 10. In a preferred embodiment, junction sub 30 may have an overall length of approximately 25.5 feet and an outer diameter of approximately 5.5 inches, opening 38 may have a length of approximately 10.5 feet, and central bore 32 may have a diameter of approximately 5 inches.

Figure 3:
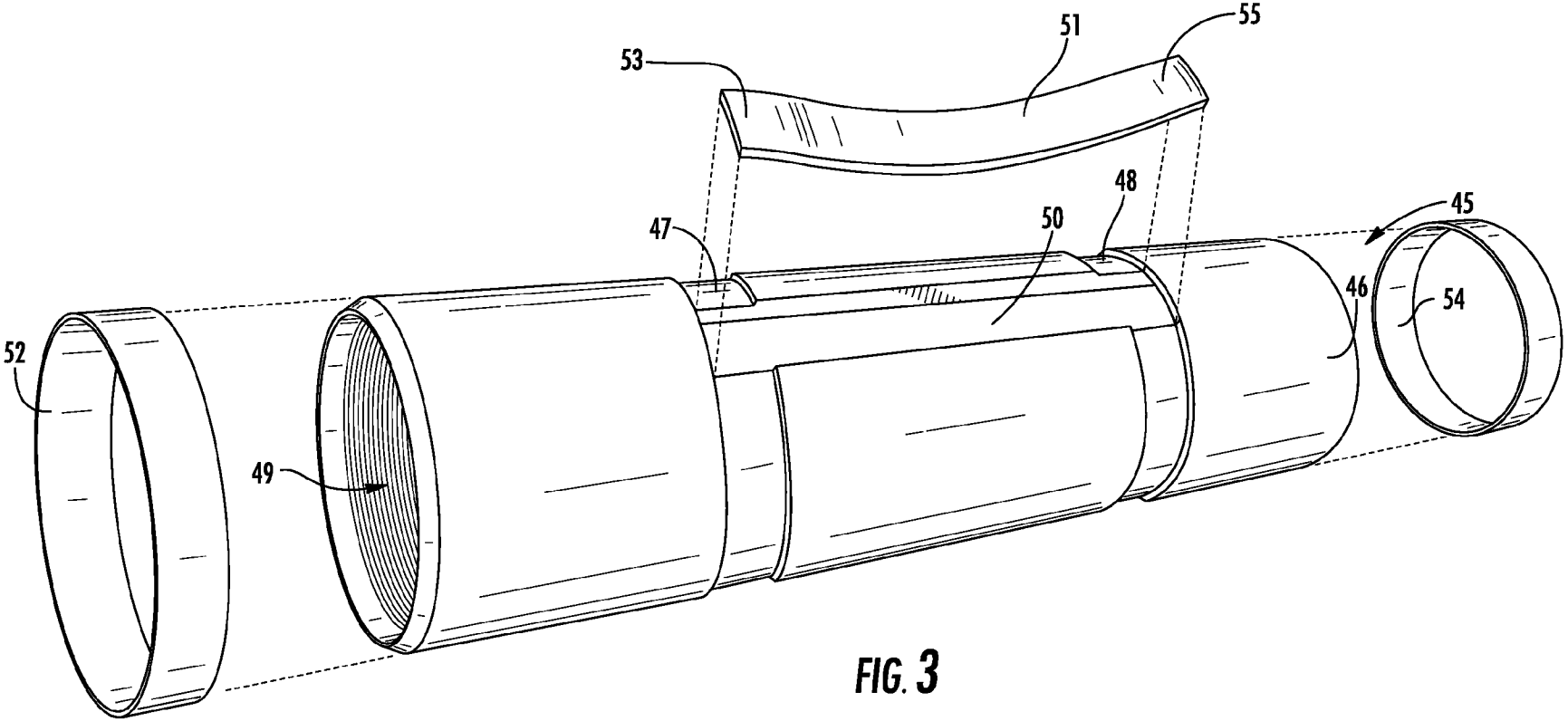
FIG. 3 is an exploded view of a spring assembly of the system.

Spring assembly 45 illustrated in FIG. 3 may include spring base 46 having first groove 47 and second groove 48 extending around a circumference of spring base 46. Spring base 46 may also include central bore 49 and slot 50 extending from first groove 47 to second groove 48. Spring member 51 may be positioned in slot 50. First ring 52 may be welded into first groove 47 over first end 53 of spring member 51 to secure first end 53 in first groove 47. Second ring 54 may be welded into second groove 48 over second end 55 of spring member 51 to secure second end 55 in second groove 48. In this way, first and second rings 52 and 54 may secure spring member 51 in slot 50 of spring base 46. Alternatively, spring member 51 may be attached to spring base 46 in any manner that would allow spring member 51 to engage a tool or device disposed through central bore 49 of spring base 46.

Figure 4:
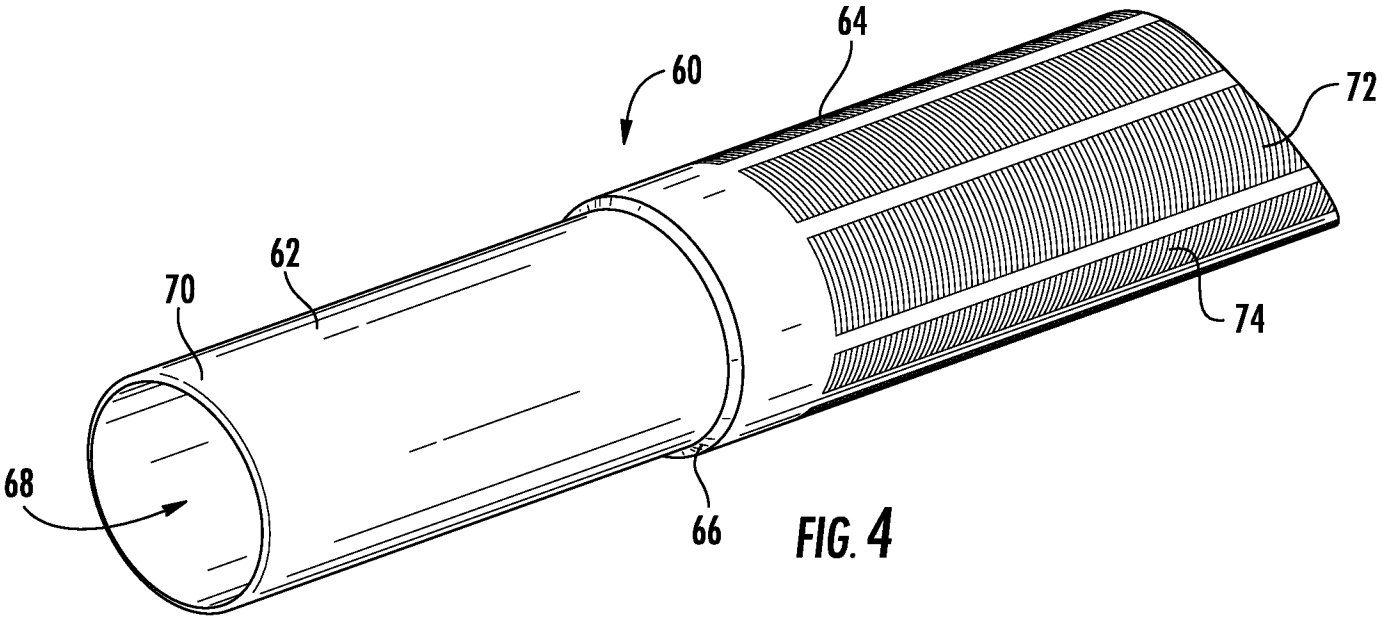
FIG. 4 is a perspective view of a tie back sub of the system.

FIG. 4 illustrates tie back sub 60, which may have a generally tubular shape. Tie back sub 60 may include first outer wall 62 and second outer wall 64 joined by interconnecting shoulder 66. Central bore 68 may extend from upper end 70 to lower end 72 and may be enclosed by first outer wall 62 and second outer wall 64. Second outer wall 64 may be tapered such that its outer diameter decreases from interconnecting shoulder 66 to lower end 72 of tie back sub 60. Tie back sub 60 may also include threads 74 extending along the circumference of second outer wall 64. Threads 74 may be designed to threadedly engage an upper end of an existing liner positioned in a lateral bore. Tie back sub 60 may be dimensioned to fit through central bore 32 of junction sub 30. In a preferred embodiment, tie back sub 60 may have an overall length of approximately 2.5 feet, first outer wall 62 may have a length of approximately 1 foot and an outer diameter of approximately 4.5 inches, second outer wall 64 may have an outer diameter that tapers from approximately 4.75 inches to approximately 4.4 inches, and central bore 68 may have a diameter of approximately 4 inches.

Figure 5A:
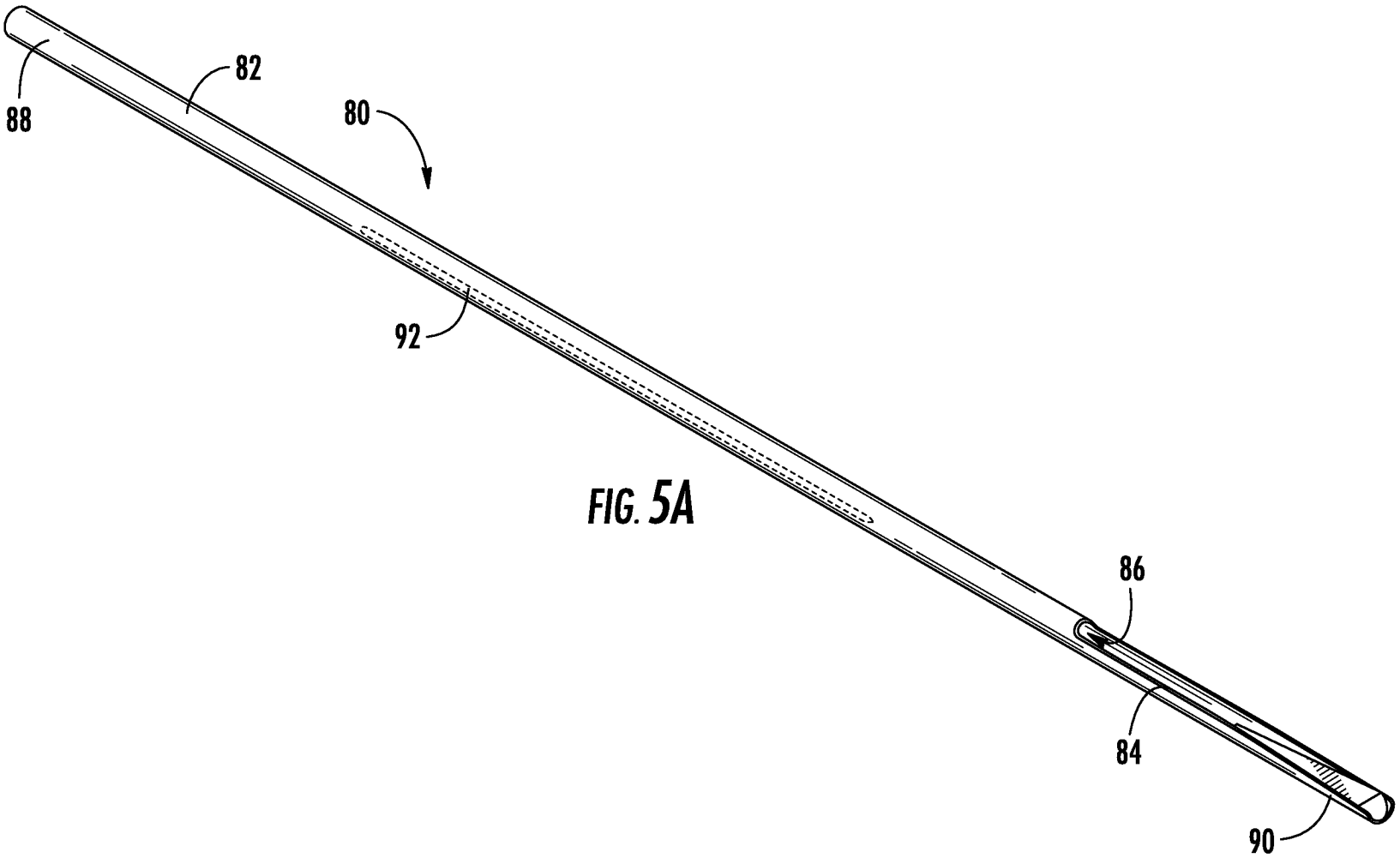
FIG. 5 is a perspective view of a window cover of the system.
Figure 5B:
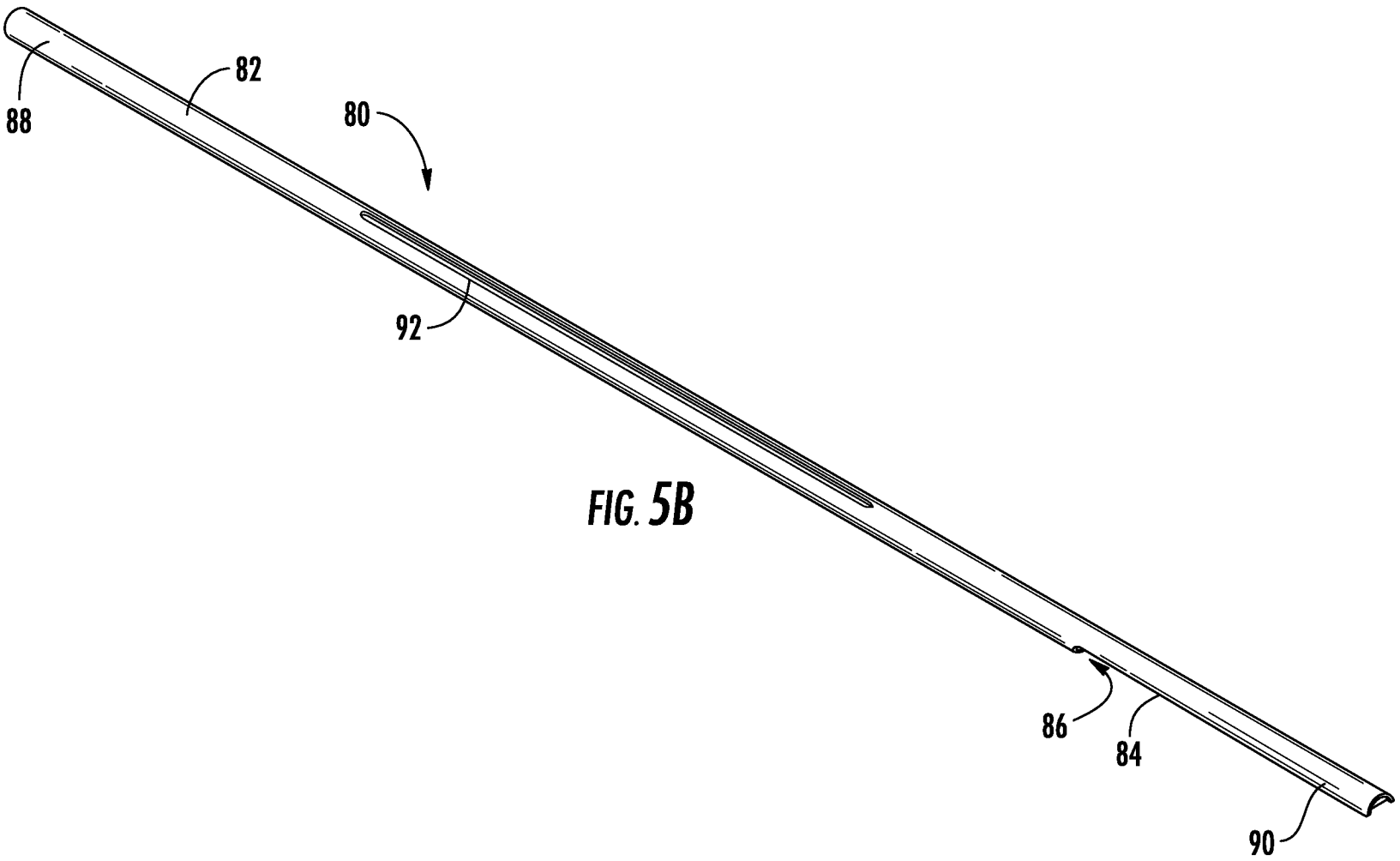

With reference to FIG. 5, window cover 80 may have a generally tubular shape, and may include outer wall 82 and tapered lower end surface 84. Central bore 86 may extend from upper end 88 to lower end 90 and may be enclosed by outer wall 82. Tapered lower end surface 84 may be designed to have a generally reciprocal shape to that of tapered upper end surface 12 of base sub 10. Window cover 80 may further include opening 92 through outer wall 82. In an alternative embodiment, window cover 80 may not include opening 92. In a preferred embodiment, window cover 80 may have an overall length of approximately 21 feet, outer wall 82 may have an outer diameter of approximately 4.75 inches, central bore 86 may have a diameter of approximately 4.25 inches, opening 92 may have a length of approximately 8 feet and a width of approximately 1.6 inches, and tapered lower end surface 84 may have a length of approximately 4.7 feet and a slope of approximately 3.2 degrees relative to outer wall 82.

Figure 6:
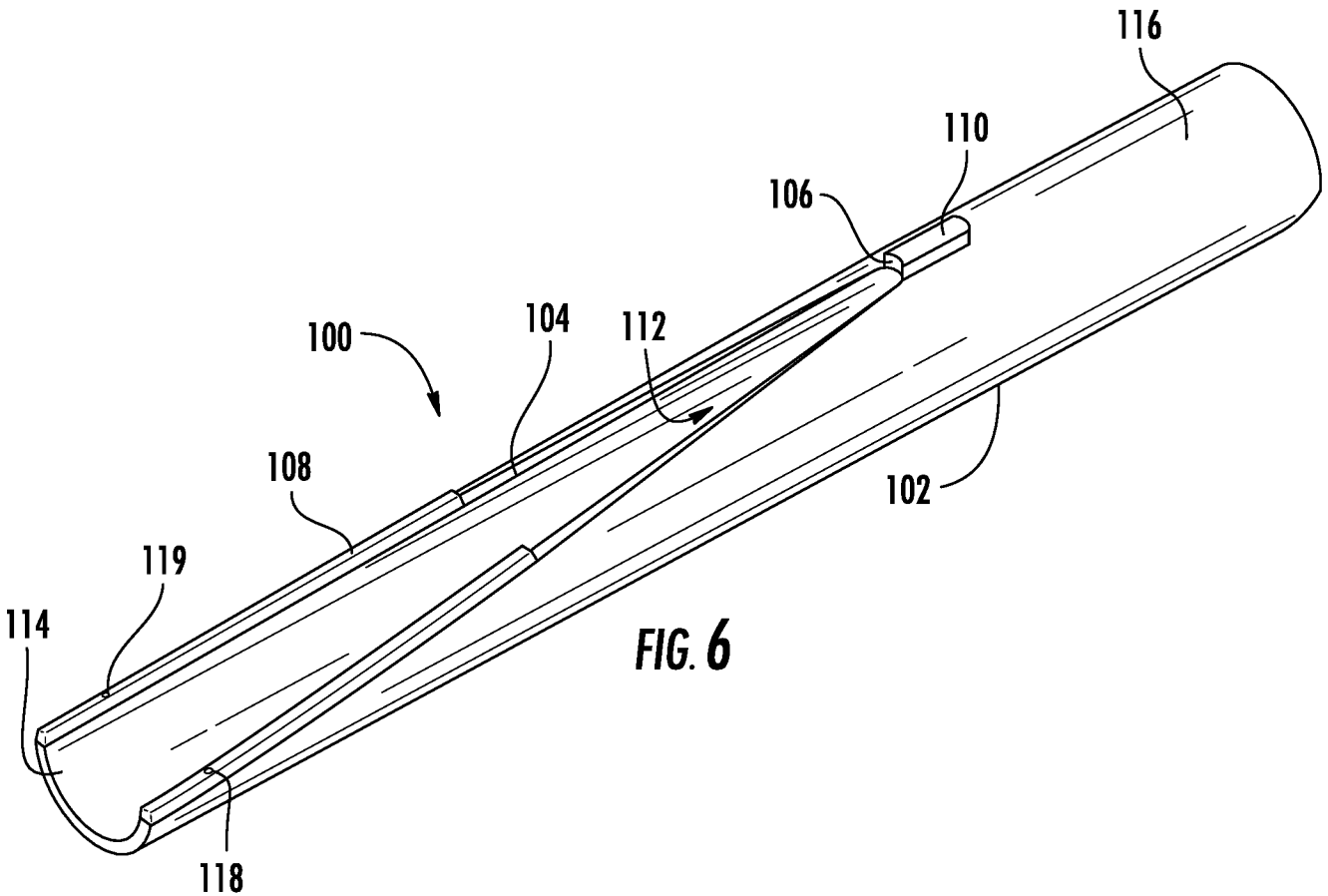
FIG. 6 is a perspective view of a reduction sub of the system.

Referring now to FIG. 6, reduction sub 100 may have a generally tubular shape, and may include outer wall 102 and tapered upper end surface 104 having apex 106. Ramp 108 may be affixed to outer wall 102 adjacent to tapered upper end surface 104. Key 110 may be affixed to outer wall 102 adjacent to apex 106 of tapered upper end surface 104. Central bore 112 may extend from upper end 114 to lower end 116 and may be enclosed by outer wall 102. Reduction sub 100 may also include bolt aperture 118 and bolt aperture 119 through ramp 108 near upper end 114. Reduction sub 100 may be dimensioned to fit within central bore 16 of base sub 10. Key 110 may be dimensioned to engage apex 14 of tapered upper end surface 12 of base sub 10 to properly align reduction sub 100 with base sub 10. In one embodiment, reduction sub 100 may be dimensioned to fit through central bore 86 of window cover 80. In a preferred embodiment, tapered upper end surface 104 may have a slope of approximately 3.2 degrees relative to outer wall 102 of reduction sub 100.

Figure 7:
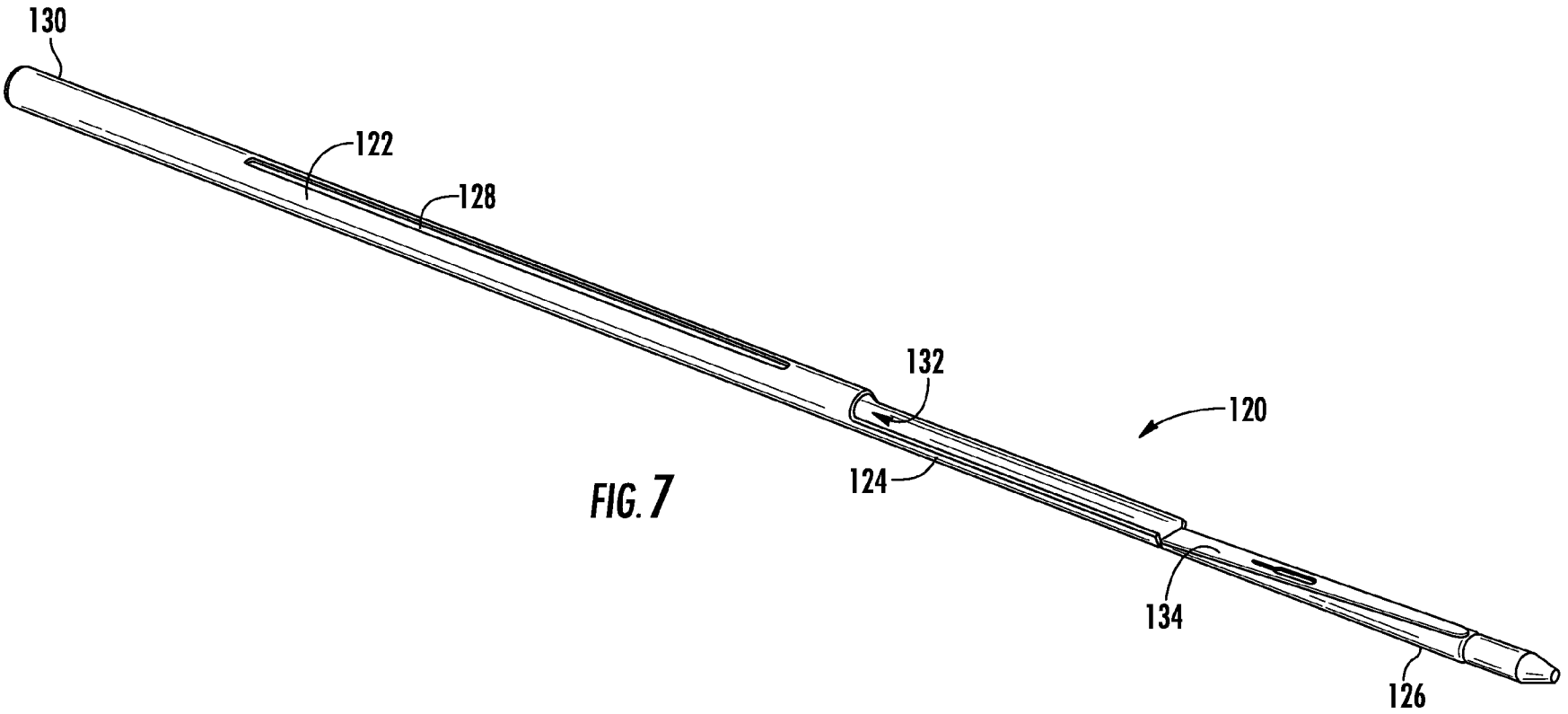
FIG. 7 is a perspective view of a diverter sub of the system.

FIG. 7 shows diverter sub 120, which may include tubular upper portion 122, U-shaped middle portion 124, and lower closed portion 126. Tubular upper portion 122 may include opening 128 through outer wall 130 and central bore 132 enclosed by outer wall 130. Lower closed portion 126 may include ramp 134. Ramp 134 may be dimensioned to engage apex 14 of tapered upper end surface 12 of base sub 10 to properly align diverter sub 120 with base sub 10. In a preferred embodiment, diverter sub 120 may have an overall length in the range of approximately 15 feet to approximately 25 feet, outer wall 130 of tubular upper portion 122 may have an outer diameter of approximately 4.75 inches, central bore 132 may have a diameter of approximately 4 inches, tubular upper portion 122 may have a length of approximately 11.3 feet, opening 128 may have a length of approximately 7.25 feet and a width of approximately 1.5 inches, U-shaped middle portion 124 may have a length of approximately 4 feet and an inner diameter of approximately 4 inches.

Figure 8A:
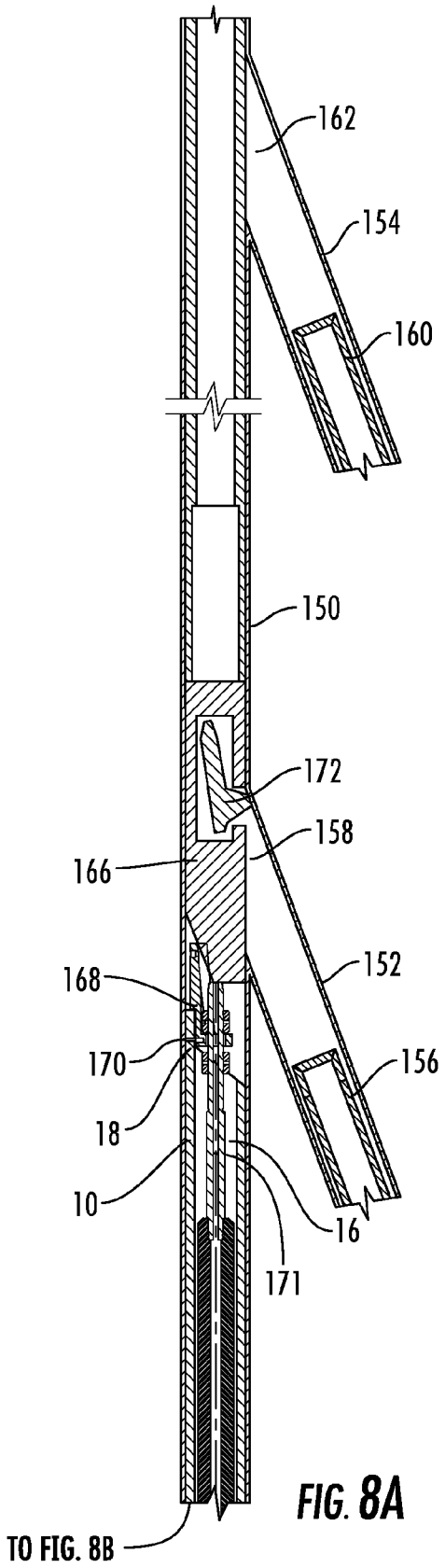
FIG. 8 is a cross-sectional view of the base sub being lowered in a main bore having two lateral bores.
Figure 8B:
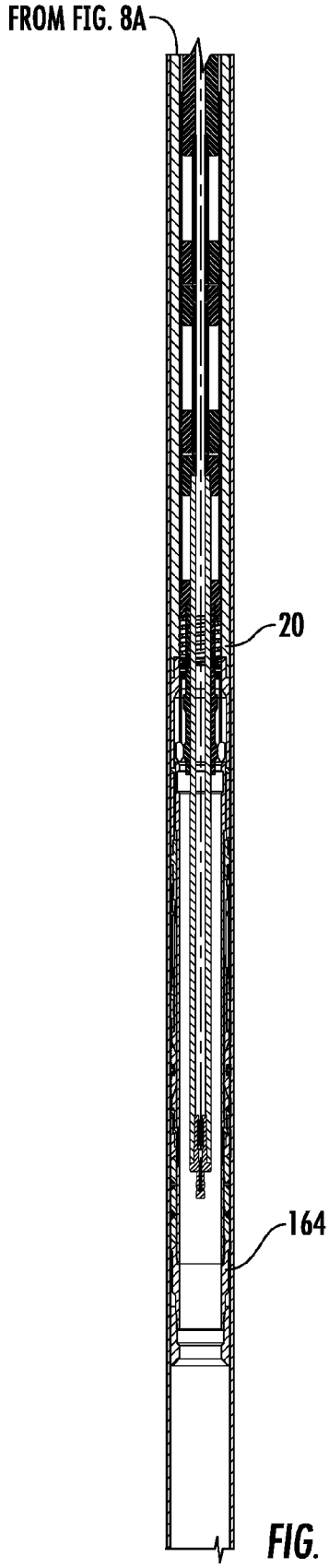

FIGS. 8-23 illustrate steps in one embodiment of a method of completing an existing liner positioned in a lateral bore. FIG. 8 illustrates a system having main bore 150 with lower lateral bore 152 and upper lateral bore 154. Existing liner 156 may be positioned in lower lateral bore 152 a certain distance lower than window 158 to lower lateral bore 152. This position of existing liner 156 may leave a portion of lower lateral bore 152 unlined and open, creating a risk of collapse. Similarly, existing liner 160 may be positioned in upper lateral bore 154 at a certain distance lower than window 162 to upper lateral bore 154. In the same way, this position of existing liner 160 may leave a portion of upper lateral bore 154 unlined and open, creating a risk of collapse.

Referring still to FIG. 8, base sub 10 may be lowered in main bore 150 with hydraulic packer 164 attached to lower end 20 of base sub 10. Base sub 10 may be lowered with a tubular string containing lateral bore window locator 166 and adapter sub 168. Adapter sub 168 may be attached to upper end 18 of base sub 10 with shear bolt 170, which may be disposed through bolt aperture 22 on base sub 10 and through a bolt aperture on adapter sub 168. Adapter sub 168 may be attached to a lower end of lateral bore window locator 166. Setting tool 171 may be disposed through a central bore of adapter sub 168 and through central bore 16 of base sub 10 in order to fluidly connect lateral bore window locator 166 to hydraulic packer 164.

Lateral bore window locator 166 may be a lateral well locator as illustrated, described, and claimed in U.S. Pat. No. 8,069,920 issued on Dec. 6, 2011, which is incorporated herein by reference. Alternatively, lateral bore window locator 166 may be a multi-window lateral well locator as illustrated, described, and claimed in U.S. patent application Ser. No. 12/796,965 filed on Jun. 9, 2010, and U.S. Patent Application Publication No. 2010/0252257 published on Oct. 7, 2010, which are both incorporated herein by reference.

Figure 9:
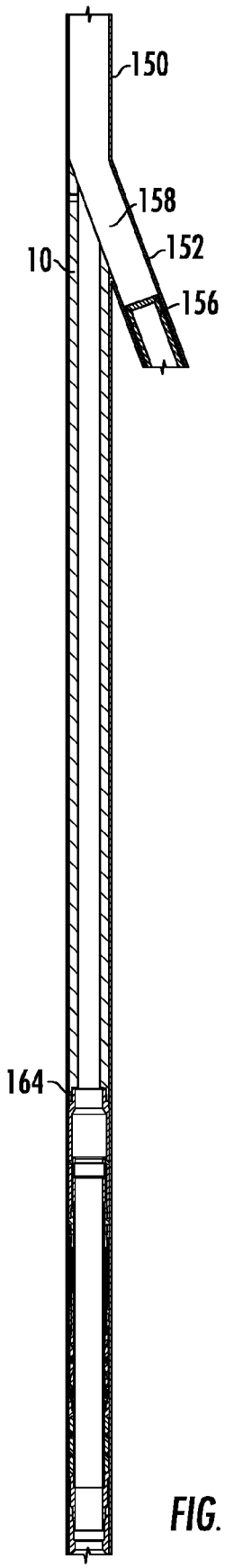
FIG. 9 is a cross-sectional view of the base sub positioned in the main bore at a window to the lower lateral bore.

Locator arm 172 of lateral bore window locator 166 may first locate and measure window 158 to lower lateral bore 152 as shown in FIG. 8 and as described in the incorporated references. Base sub 10 may then be positioned such that upper end 18 and tapered upper end surface 12 are aligned with window 158 to lower lateral bore 152 as shown in FIG. 9. Hydraulic packer 164 may then be activated using setting tool 171 such that hydraulic packer 164 supports base sub 10 in the above-described position. Shear bolt 170 may then be mechanically sheared, as will be readily understood by one skilled in the art, in order to separate base sub 10 and attached hydraulic packer 164 from adapter sub 168 and the remainder of the tubular string used to lower base sub 10, including lateral bore window locator 166 and setting tool 171. The tubular string with lateral bore window locator 166, adapter sub 168, and setting tool 171 may then be lifted out of main bore 150 leaving base sub 10 and hydraulic packer 164 in position in main bore 150 at window 158 to lower lateral bore 152 as shown in FIG. 9.

Lateral bore window locator 166 may also locate and measure window 162 to upper lateral bore 154 while lowering the tubular string with base sub 10 or while lifting the tubular string in main bore 150 after positioning base sub 10 at window 158 to lower lateral bore 152. A multi-window lateral well locator may be used to accomplish locating both windows 158 and 162 before removing lateral bore window locator 166 from main bore 150.

Figure 10A:
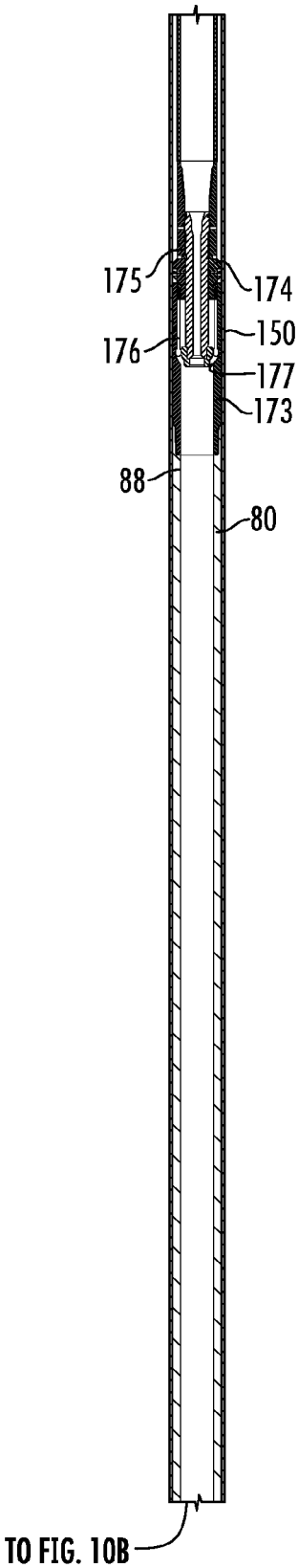
FIG. 10 is a cross-sectional view of the window cover positioned above the base sub in the main bore.
Figure 10B:
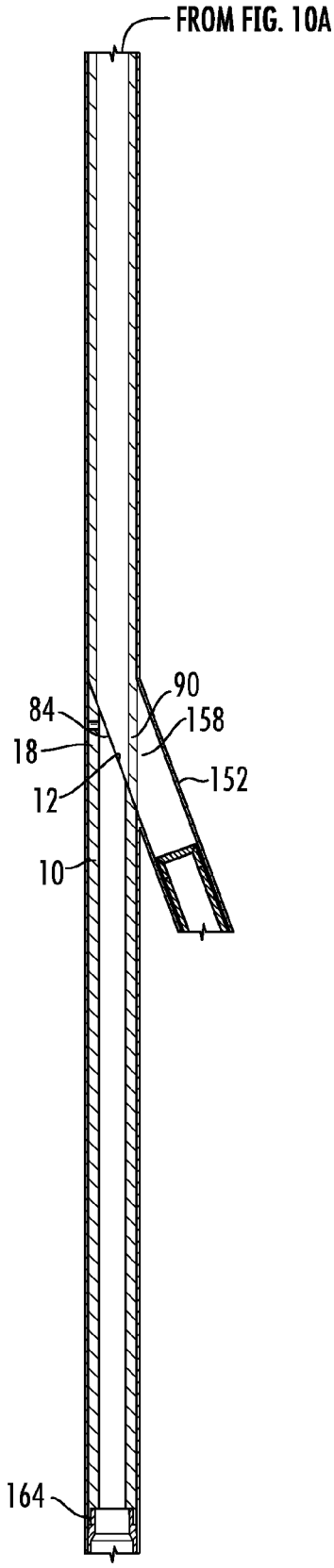

With reference to FIG. 10, window cover 80 may be lowered in main bore 150 at the lower end of a tubular string. Window cover 80 used in this step of the process may not include opening 92 as discussed in connection with FIG. 5 above. Upper end 88 of window cover 80 may be attached to receptacle sub 173, which may be attached to drop off tool 174. Piston 175 of drop off tool 174 may force collets 176 of drop off tool 174 to engage recess 177 in receptacle sub 173 in order to attach receptacle sub 173 to drop off tool 174. Window cover 80 may be positioned at window 158 to lower lateral bore 152 such that tapered lower end surface 84 of window cover 80 engages tapered upper end surface 12 of base sub 10. Drop off tool 174 may then be activated by forcing piston 175 to move downward such that collets 176 are released from recess 177, thereby separating drop off tool 174 from receptacle sub 173, which remains attached to window cover 80. The tubular string containing drop off tool 174 may then be lifted out of main bore 150 leaving window cover 80 and receptacle sub 173 in position above base sub 10 and covering window 158 to lower lateral bore 152. In this position, window cover 80 may prevent a tool or device that is subsequently lowered in main bore 150 from entering lower lateral bore 152 at window 158.

Figure 11A:
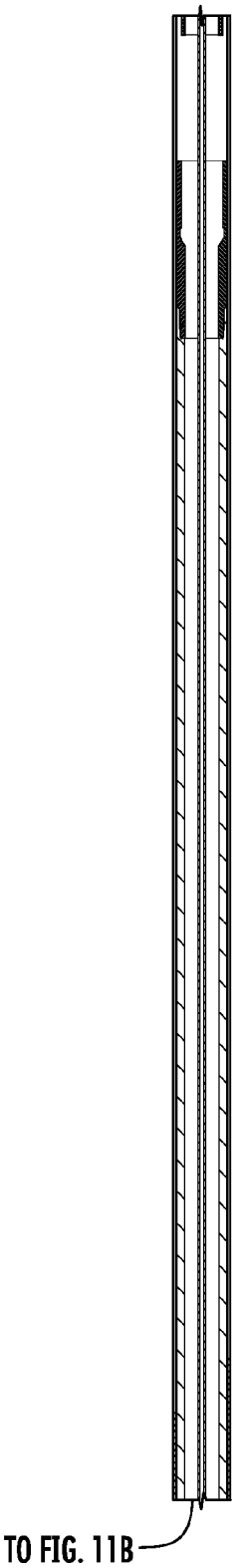
FIG. 11 is a cross-sectional view of the reduction sub being positioned in a central bore of the base sub.
Figure 11B:
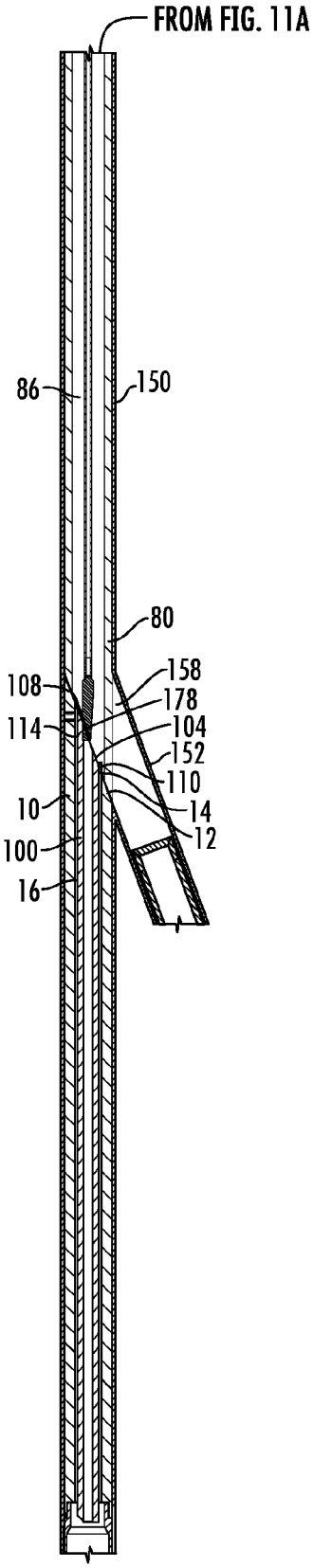

Referring now to FIG. 11, reduction sub 100 may be lowered in main bore 150 at the lower end of a tubular sting. Upper end 114 of reduction sub 100 may be attached to setting tool 178 with two shear bolts, which may be disposed through bolt apertures 118 and 119 on reduction sub 100 (shown in FIG. 6) and through two bolt apertures on setting tool 178. Reduction sub 100 may be lowered through central bore 86 of window cover 80 into central bore 16 of base sub 10. Window cover 80 may prevent reduction sub 100 from entering lower lateral bore 152. In an alternative embodiment, reduction sub 100 may be lowered without first positioning window cover 80 at window 158 to lower lateral bore 152. Key 110 of reduction sub 100 may engage apex 14 of tapered upper end surface 12 on base sub 10, thereby aligning tapered upper end surface 104 of reduction sub 100 with tapered upper end surface 12 of base sub 10. The two shear bolts may then be mechanically sheared, as will be readily understood by one skilled in the art, in order to separate reduction sub 100 from setting tool 178 and the remainder of the tubular string used to lower reduction sub 100. The tubular string, including setting tool 178, may then be lifted out of main bore 150 leaving reduction sub 100 in position within central bore 16 of base sub 10.

Figure 12:
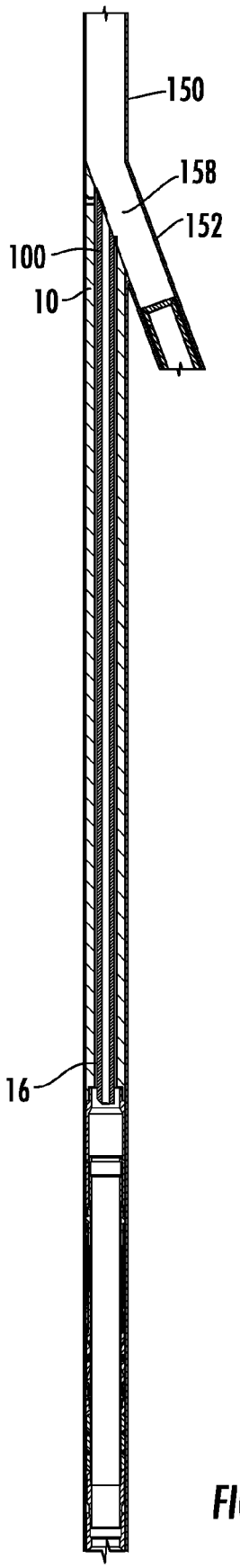
FIG. 12 is a cross-sectional view of the base sub and the reduction sub positioned at the window to the lower lateral bore.

Window cover 80 may be removed from main bore 150 after reduction sub 100 is positioned in central bore 16 of base sub 10 leaving only base sub 10 and reduction sub 100 positioned at window 158 to lower lateral bore 152 (as shown in FIG. 12). The removal of window cover 80 may be accomplished by lowering in main bore 150 a tubular string with drop off tool 174 (shown in FIG. 10) attached to its lower end. Recess 177 of receptacle sub 173 may engage collets 176 of drop off tool 174, thereby again attaching receptacle sub 173 to drop off tool 174. Receptacle sub 173 and attached window cover 80 may then be lifted out of main bore 150 with the tubular string having drop off tool 174 at its lower end.

Figure 13A:
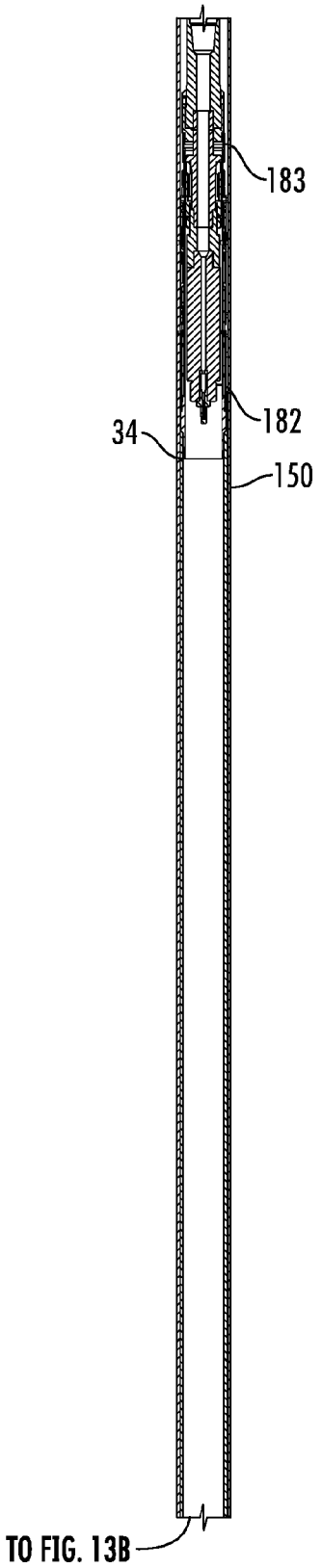
FIG. 13 is a cross-sectional view of the junction sub positioned in the lower lateral bore.
Figure 13B:
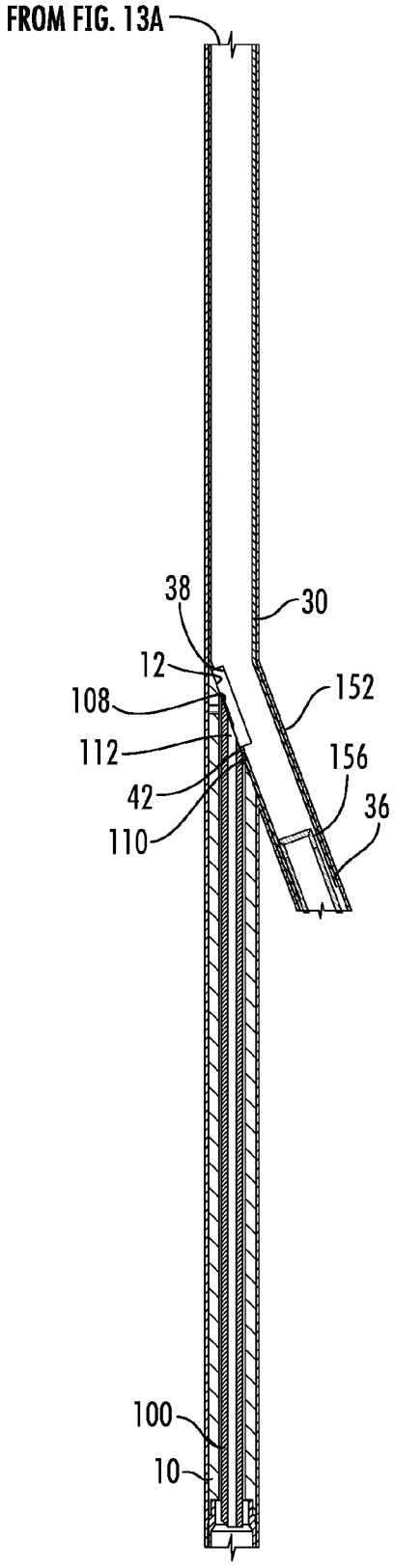

As shown in FIG. 13, junction sub 30 may be lowered in main bore 150 at the end of a tubular string. Upper end 34 of junction sub 30 may be attached to hydraulic hanger 182, which may be attached to hydraulic setting tool 183. Junction sub 30 may be lowered into lower lateral bore 152. Tapered upper end surface 12 of base sub 10 and ramp 108 of reduction sub 100 may direct junction sub 30 into lower lateral bore 152. Key 42 of junction sub 30 may engage key 110 of reduction sub 100 to align opening 38 of junction sub 30 with central bore 112 of reduction sub 100. In position, lower end 36 of junction sub 30 may overlap existing liner 156 in lower lateral bore 152. After junction sub 30 is positioned and aligned, hydraulic hanger 182 may then be activated such that hydraulic hanger 182 engages main bore 150, thereby supporting junction sub 30 in the above-described position. Hydraulic setting tool 183 may then be separated from hydraulic hanger 182 and attached junction sub 30. The tubular string containing hydraulic setting tool 183 may then be lifted out of main bore 150 leaving junction sub 30 and hydraulic hanger 182 in position in main bore 150 and lower lateral bore 152.

Figure 14A:
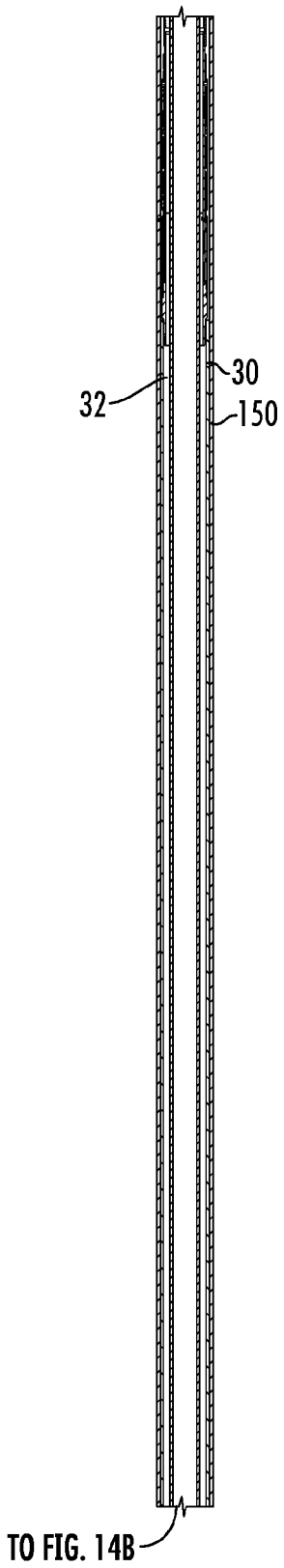
FIG. 14 is a cross-sectional view of the tie back sub positioned in the lower lateral bore.
Figure 14B:
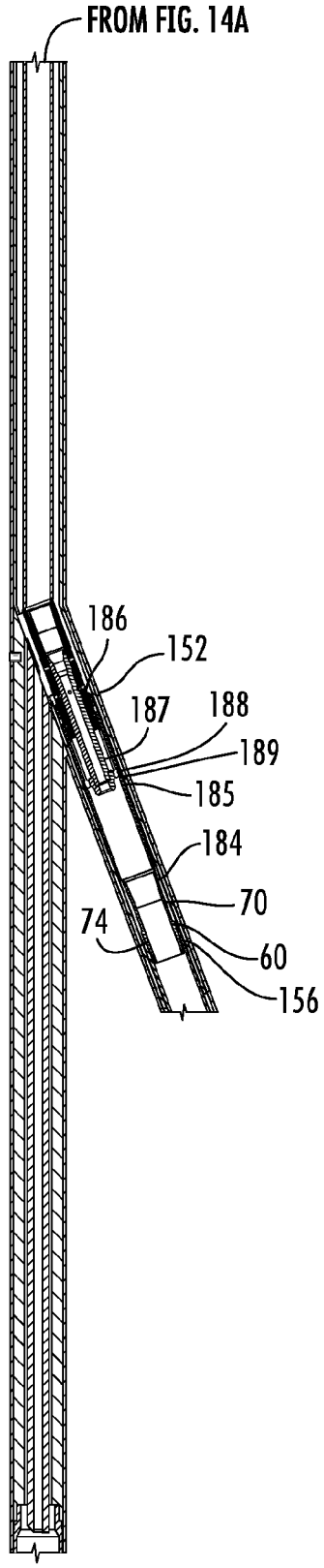

With reference now to FIG. 14, tie back sub 60 may be lowered in main bore 150 at the end of a tubular string. Upper end 70 of tie back sub 60 may be attached to tubular member 184, which may be attached to receptacle sub 185. Tubular member 184 may serve to fill in the space within lower lateral bore 152 between existing liner 156 and window 158. In one embodiment, two or more tubular members may be attached between upper end 70 of tie back sub 60 and receptacle sub 185, the number of tubular members used depending upon the distance between the upper end of existing liner 156 and window 158 to lower lateral bore 152. Alternatively, upper end 70 of tie back sub 60 may be directly attached to receptacle sub 185. In each of these embodiments, receptacle sub 185 may be attached to drop off tool 186. Piston 187 of drop off tool 186 may force collets 188 of drop off tool 186 to engage recess 189 in receptacle sub 185 in order to attach receptacle sub 185 to drop off tool 186. Tie back sub 60 may be lowered at the end of the above-described tubular string through main bore 150 and central bore 32 of junction sub 30 to existing liner 156 in lower lateral bore 152. The tubular string may be rotated such that threads 74 of tie back sub 60 engage existing liner 156 in lower lateral bore 152. Drop off tool 186 may then be activated by forcing piston 187 to move downward such that collets 188 are released from recess 189, thereby separating drop off tool 186 from receptacle sub 185. Receptacle sub 185 may remain attached to tubular member 184 and tie back sub 60, which may now be threadedly attached to existing liner 156. The tubular string containing drop off tool 186 may then be lifted out of central bore 32 of junction sub 30 and main bore 150 leaving tie back sub 60 threadedly attached to existing liner 156 in lower lateral bore 152. In this way, the lateral liner tie back system may be used to complete existing liner 156 in lower lateral bore 152.

Figure 15:
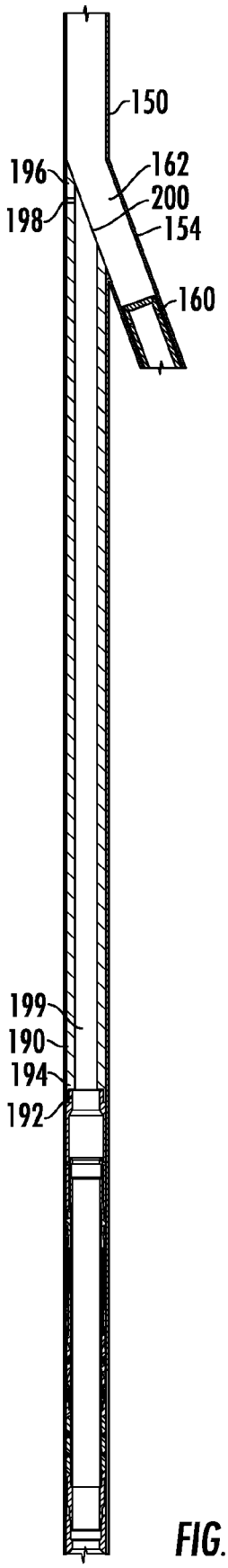
FIG. 15 is a cross-sectional view of an upper base sub positioned in the main bore at a window to the upper lateral bore.
Figure 16A:
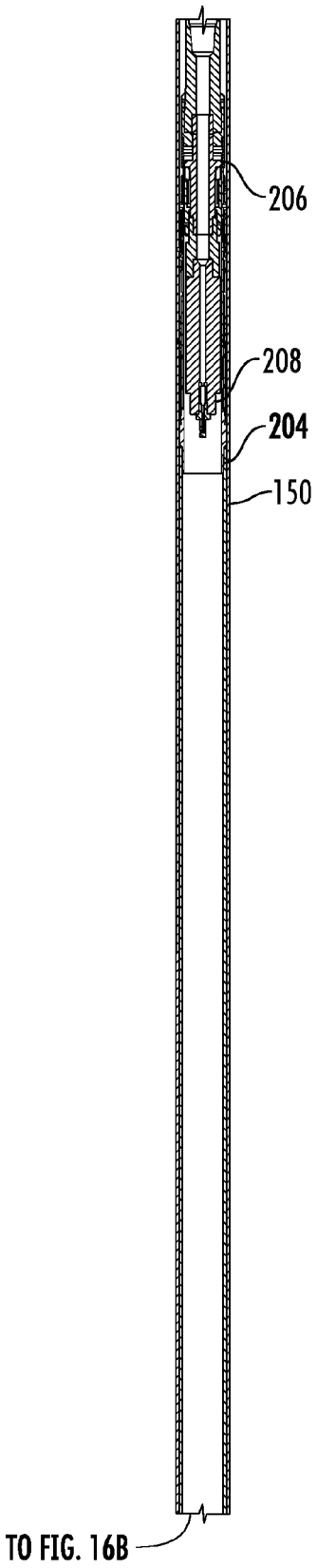
FIG. 16 is a cross-sectional view of an upper junction sub positioned in the upper lateral bore.
Figure 16B:
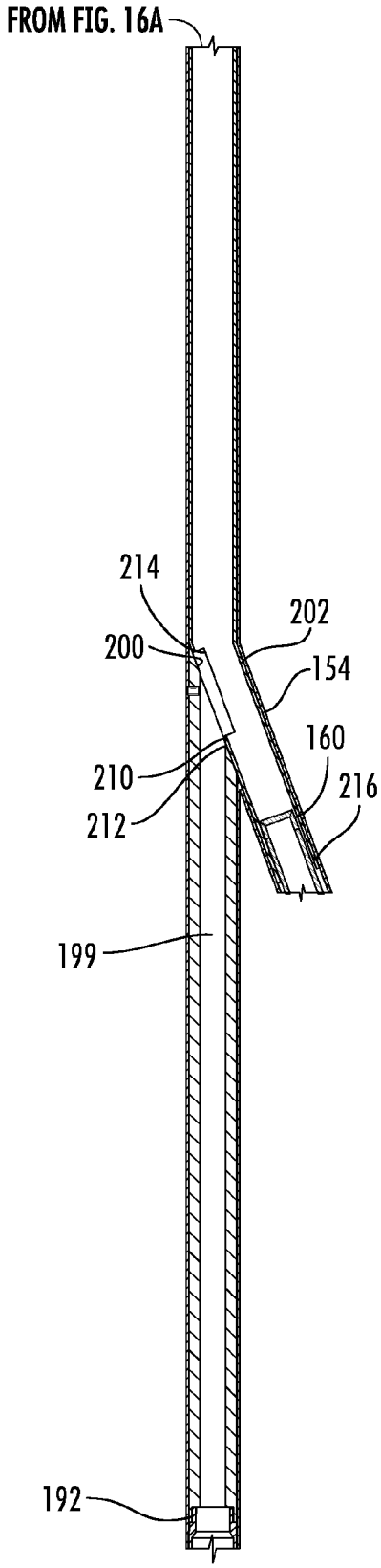
Figure 17A:
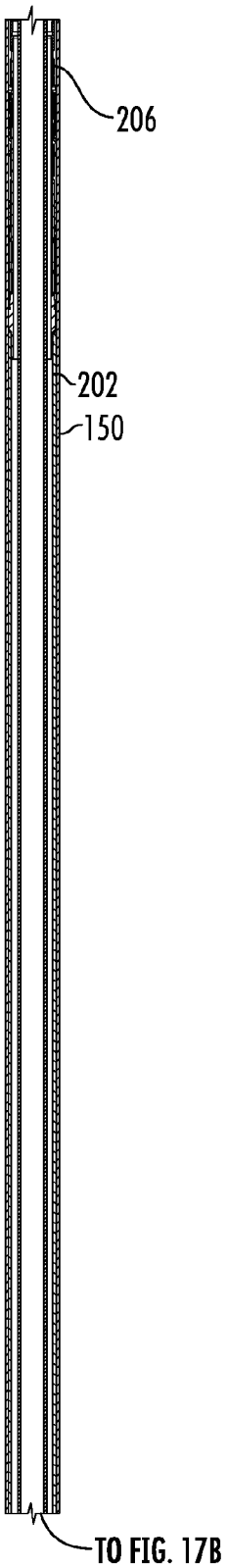
FIG. 17 is a cross-sectional view of an upper tie back sub positioned in the upper lateral bore.
Figure 17B:
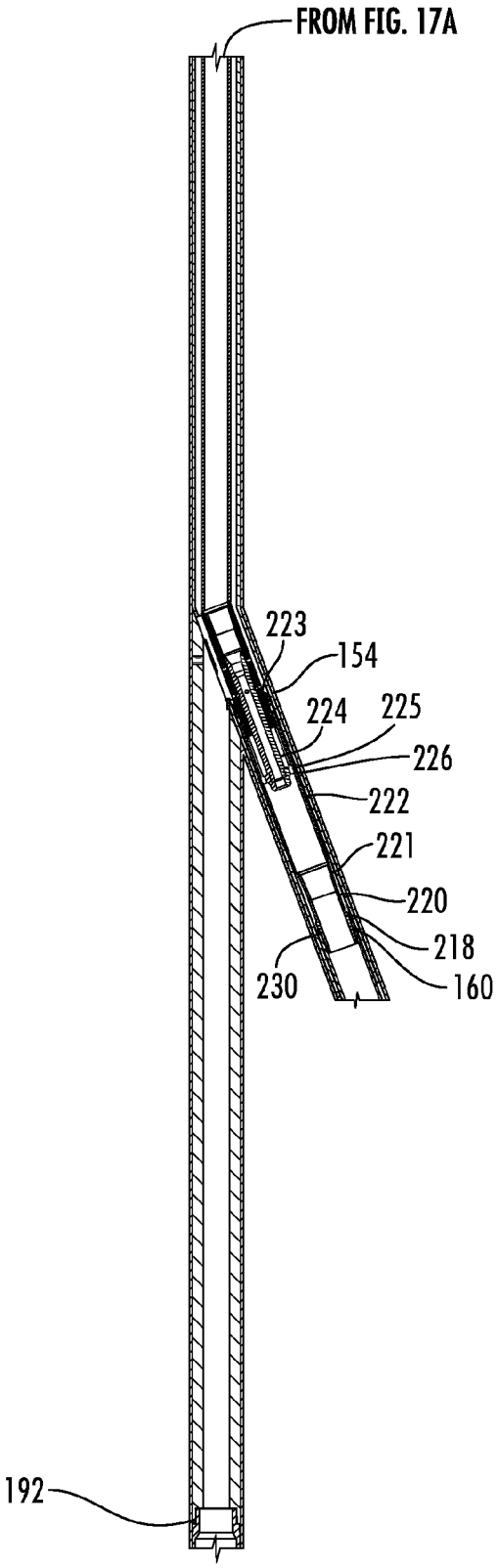

FIGS. 15-17 illustrate the steps in one embodiment of a method of completing existing liner 160 in upper lateral bore 154. Referring first to FIG. 15, upper base sub 190 may be lowered in main bore 150 with a tubular string containing lateral bore window locator 166 and adapter sub 168, and with hydraulic packer 192 attached to lower end 194 of upper base sub 190 in the same way that base sub 10 is lowered in main bore 150 (shown in FIG. 8). Upper base sub 190 may be a duplicate of base sub 10 having the same features and dimensions. Alternatively, upper base sub 190 may have differing dimensions and/or features from those of base sub 10. Adapter sub 168 may be attached to upper end 196 of upper base sub 190 with a shear bolt disposed through bolt aperture 198 on upper base sub 190 and through a bolt aperture on adapter sub 168. Adapter sub 168 may be attached to a lower end of lateral bore window locator 166. Setting tool 171 may be disposed through a central bore of adapter sub 168 and through central bore 199 of upper base sub 190 in order to fluidly connect lateral bore window locator 166 to hydraulic packer 192, in a manner similar to that described in connection with FIG. 8.

As described above in connection with FIG. 8 and base sub 10, lateral bore window locator 166 may first locate and measure window 162 to upper lateral bore 154. Upper base sub 190 may then be positioned such that upper end 196 and tapered upper end surface 200 of upper base sub 190 are aligned with window 162 to upper lateral bore 154 as shown in FIG. 15. Hydraulic packer 192 may then be activated using setting tool 171 such that hydraulic packer 192 supports upper base sub 190 in the above-described position. The shear bolt may then be mechanically sheared, as will be readily understood by one skilled in the art, in order to separate upper base sub 190 and attached hydraulic packer 192 from adapter sub 168 and the remainder of the tubular string used to position upper base sub 190 in main bore 150, including lateral bore window locator 166 and setting tool 171. The tubular string with lateral bore window locator 166, adapter sub 168, and setting tool 171 may then be lifted out of main bore 150 leaving upper base sub 190 and hydraulic packer 192 in position in main bore 150 at window 162 to upper lateral bore 154 as shown in FIG. 15.

Hydraulic packer 192 may be a duplicate of or similar to hydraulic packer 164. Alternatively, hydraulic packer 192 may have differing dimensions and features from those of hydraulic packer 164. Adapter sub 168, lateral bore window locator 166, and setting tool 171 may be the same as, duplicates of, or similar to the tools used in connection with lowering and positioning base sub 10 at lower lateral bore 152. Alternatively, adapter sub 168, lateral bore window locator 166, and setting tool 171 may each have differing features and/or dimensions from those of the tools used to lower and position base sub 10 at lower lateral bore 152.

In an alternative embodiment described above, a multi-window lateral well locator may be used to locate and measure window 162 to upper lateral bore 154 while lowering base sub 10 or while removing the tubular string used to lower and position base sub 10 at lower lateral bore 152. In this alternative embodiment, upper base sub 190 may be lowered with a tubular string that does not include lateral bore window locator 166, and instead includes only adapter sub 168 above upper base sub 190 and setting tool 171 disposed through central bore 199 of upper base sub 190.

Referring now to FIG. 16, upper junction sub 202 may be lowered in main bore 150 at the end of a tubular string. Upper junction sub 202 may be a duplicate of junction sub 30 having the same features and dimensions. Alternatively, upper junction sub 202 may have differing dimensions and/or features from those of junction sub 30. Upper end 204 of upper junction sub 202 may be attached to hydraulic hanger 206, which may be attached to hydraulic setting tool 208. Upper junction sub 202 may be lowered into upper lateral bore 154. Tapered upper end surface 200 of upper base sub 190 may direct upper junction sub 202 into upper lateral bore 154. Key 210 of upper junction sub 202 may engage apex 212 of tapered upper end surface 200 of upper base sub 190 to align opening 214 of upper junction sub 202 with central bore 199 of upper base sub 190. In position, lower end 216 of upper junction sub 202 may overlap existing liner 160 in upper lateral bore 154. After upper junction sub 202 is positioned and aligned, hydraulic hanger 206 may be activated such that hydraulic hanger 206 engages main bore 150, thereby supporting upper junction sub 202 in the above-described position. Hydraulic setting tool 208 may then be separated from hydraulic hanger 206 and attached upper junction sub 202. The tubular string containing hydraulic setting tool 208 may then be lifted out of main bore 150 leaving upper junction sub 202 and hydraulic hanger 206 in position in main bore 150 and upper lateral bore 154. Hydraulic hanger 206 may be a duplicate of or similar to hydraulic hanger 182. Alternatively, hydraulic hanger 206 may have differing dimensions and/or features from those of hydraulic hanger 182. Hydraulic setting tool 208 may be a duplicate of or similar to hydraulic setting tool 183. Alternatively, hydraulic setting tool 208 may have differing dimensions and/or features from those of hydraulic setting tool 183.

As shown in FIG. 17, upper tie back sub 218 may be lowered in main bore 150 at the end of a tubular string. Upper tie back sub 218 may be a duplicate of or similar to tie back sub 60 having the same features and dimensions. Alternatively, upper tie back sub 218 may have differing features and/or dimensions from those of tie back sub 60. Upper end 220 of upper tie back sub 218 may be attached to tubular member 221, which may be attached to receptacle sub 222. Tubular member 221 may serve to fill in the space within upper lateral bore 154 between existing liner 160 and window 162. In one embodiment, two or more tubular members may be attached between upper end 220 of upper tie back sub 218 and receptacle sub 222, the number of tubular members used depending upon the distance between the upper end of existing liner 160 and window 162 to upper lateral bore 154. Alternatively, upper end 220 of upper tie back sub 218 may be directly attached to receptacle sub 222. In each of these embodiments, receptacle sub 222 may be attached to drop off tool 223. Piston 224 of drop off tool 223 may force collets 225 of drop off tool 223 to engage recess 226 in receptacle sub 222 in order to attach receptacle sub 222 to drop off tool 223. Upper tie back sub 218 may be lowered through main bore 150 and central bore 228 of upper junction sub 202 to existing liner 160 in upper lateral bore 154. The tubular string may be rotated such that threads 230 of upper tie back sub 218 engage existing liner 160. Drop off tool 223 may then be activated by forcing piston 224 to move downward such that collets 225 are released from recess 226, thereby separating drop off tool 223 from receptacle sub 222. Receptacle sub 222 may remain attached to tubular member 221 and upper tie back sub 218, which may now be threadedly attached to existing liner 160. The tubular string containing drop off tool 223 may then be lifted out of central bore 228 of upper junction sub 202 and main bore 150 leaving upper tie back sub 218 in position above existing liner 160 in upper lateral bore 154. In this way, the lateral liner tie back system may be used to complete existing liner 160 in upper lateral bore 154. Receptacle sub 222 may be a duplicate of or similar to receptacle sub 185. Alternatively, receptacle sub 222 may have differing dimensions and/or features from those of receptacle sub 185. Drop off tool 223 may be the same as, a duplicate of, or similar to drop off tool 186. Alternatively, drop off tool 223 may have differing dimensions and/or features from those of drop off tool 186.

Alternatively, the lateral liner tie back system may be used to complete only existing liner 156 in lower lateral bore 152. In another alternative, the lateral liner tie back system may be used to complete only existing liner 160 in upper lateral bore 154. In yet another alternative, the lateral liner tie back system may be used to complete an existing liner in a lateral bore in a system having only one lateral bore. In each of these alternative embodiments, the steps illustrated and described in connection with FIGS. 15-17 may be followed.

After completing existing liners 156 and 160 in lower and upper lateral bores 152 and 154, the lateral liner tie back system may be used to selectively direct a tool, such as a milling apparatus or production equipment, into upper lateral bore 154, lower lateral bore 152, or a portion of main bore 150 below base sub 10. FIGS. 18-23 illustrate one embodiment of this method.

Figure 18A:
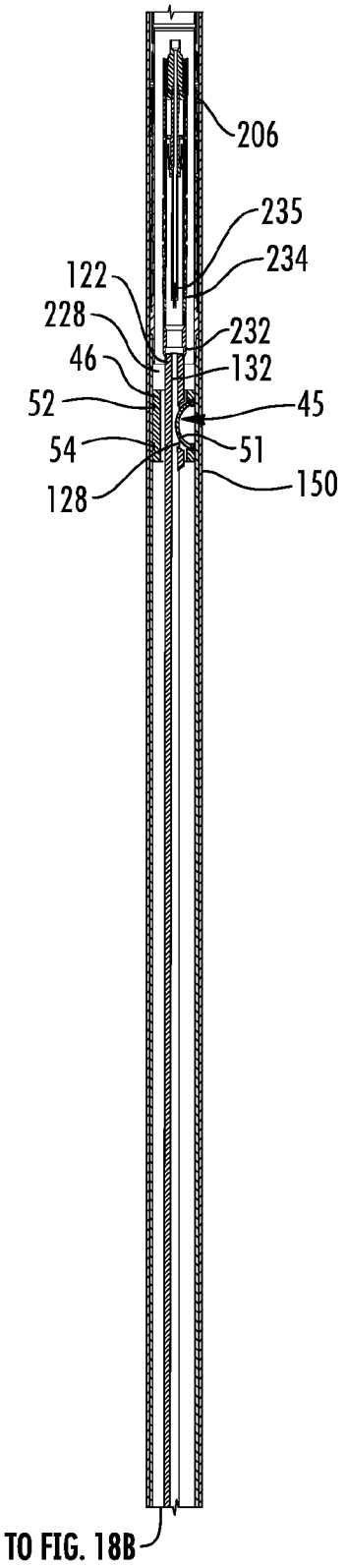
FIG. 18 is a cross-sectional view of the diverter sub positioned in a central bore of the upper base sub.
Figure 18B:
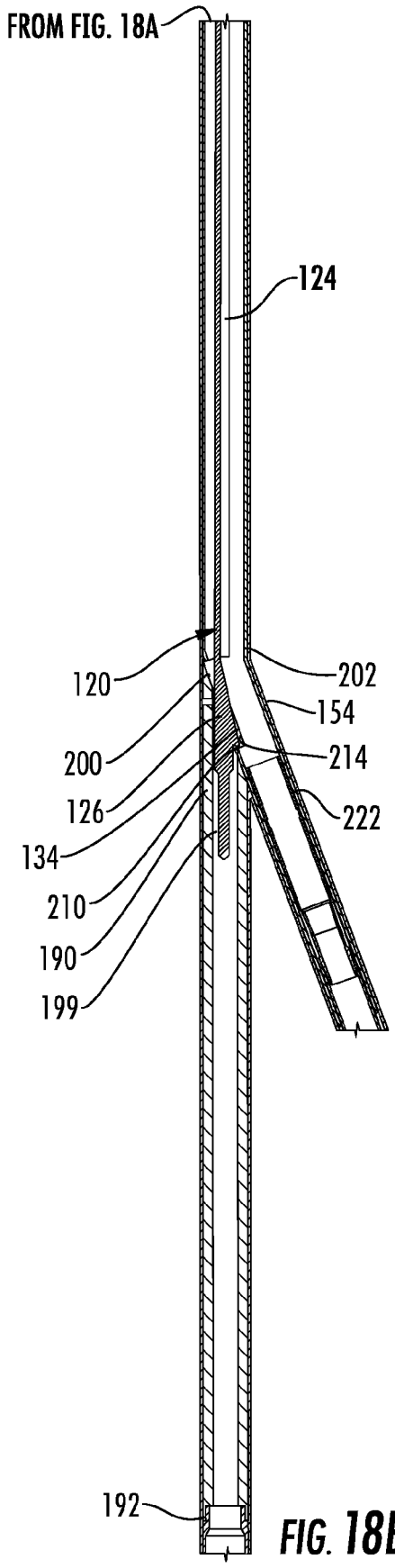

With reference to FIG. 18, spring assembly 45 may be attached within central bore 228 of upper junction sub 202 above opening 214. Spring assembly 45 may be attached by any means, such as by welding or with bolts. Spring assembly 45 may be positioned such that spring member 51 and opening 214 are on opposing sides of upper junction sub 202.

Referring still to FIG. 18, diverter sub 120 may be lowered in main bore 150 with a tubular string. Upper tubular portion 122 of diverter sub 120 may be attached to connector sub 232, which may be attached to hydraulic packer 234. Hydraulic setting tool 235 may also be included in the tubular string. Diverter sub 120 may be lowered through central bore 228 and opening 214 of upper junction sub 202 and into central bore 199 of upper base sub 190. Ramp 134 of diverter sub 120 may engage key 210 of upper junction sub 202 and tapered upper end surface 200 of upper base sub 190. Opening 128 in upper tubular portion 122 of diverter sub 120 may engage spring member 51 of spring assembly 45 to align ramp 134 of diverter sub 120 with upper lateral bore 154. Hydraulic setting tool 235 may activate hydraulic packer 234 such that diverter sub 120 and hydraulic packer 234 are supported in the above-described position. The tubular string containing hydraulic setting tool 235 may then be lifted out of main bore 150.

Figure 19A:
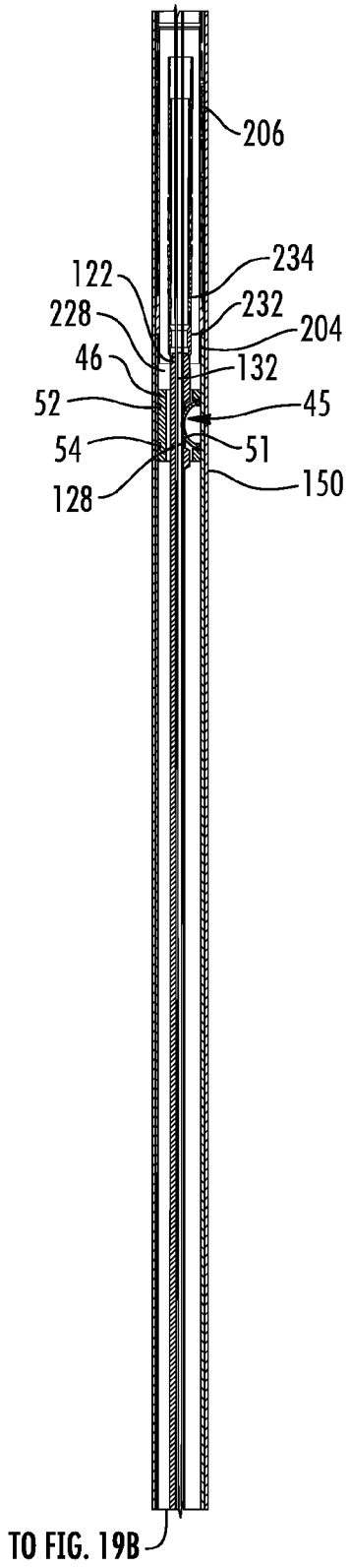
FIG. 19 is a cross-sectional view of the diverter sub directing a tool into the upper lateral bore.
Figure 19B:
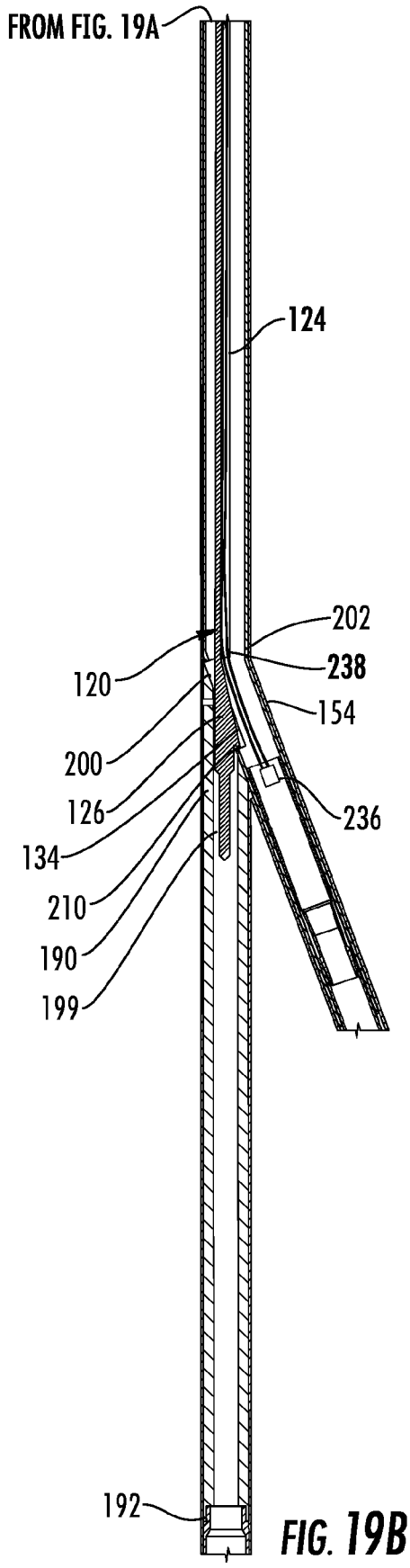

Referring now to FIG. 19, tool 236 attached to the end of tubular string 238 may be lowered through main bore 150, through central bore 228 of upper junction sub 202, through central bore 132 of upper tubular portion 122 of diverter sub 120, and through U-shaped middle portion 124 of diverter sub 120. As tool 236 is lowered past U-shaped middle portion 124 of diverter sub 120, tool 236 may be directed into upper lateral bore 154 by ramp 134 of lower closed portion 126 of diverter sub 120. In this way, diverter sub 120 may direct tool 236 lowered through main bore 150 into upper lateral bore 154. Alternatively, diverter sub 120 may be used to direct a tool lowered through a main bore into a lower lateral bore or the lateral bore in a system having only one lateral bore. If diverter sub 120 is used to direct a tool lowered through a main bore into a lower lateral bore, there is preferably no base sub positioned in the main bore above the lower lateral bore. Diverter sub 120 may later be removed to clear central bore 199 of upper base sub 190. Removal of diverter sub 120 may be accomplished by lowering a retrieval tool to disengage hydraulic packer 234 and to lift hydraulic packer 234 and diverter sub 120 out of main bore 150.

Figure 20A:
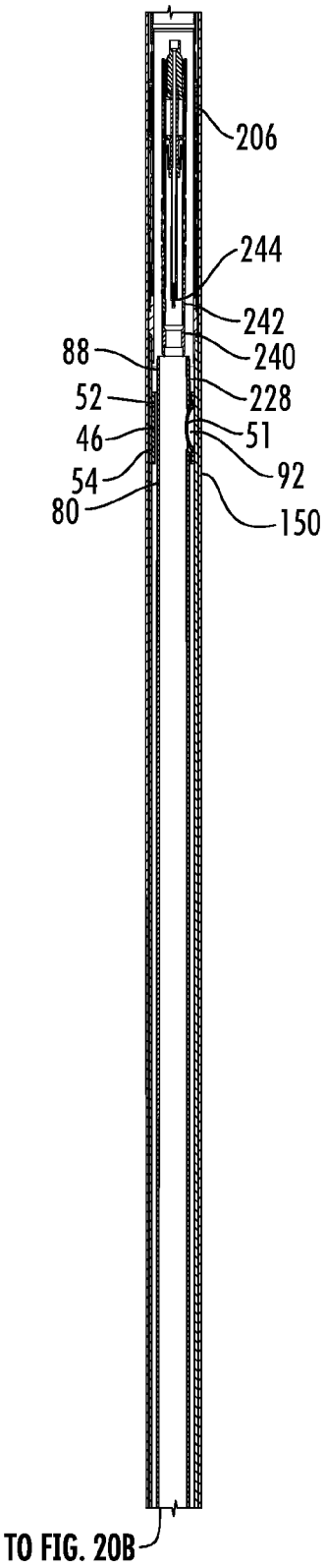
FIG. 20 is a cross-sectional view of the window cover positioned above the upper base sub in the main bore.
Figure 20B:
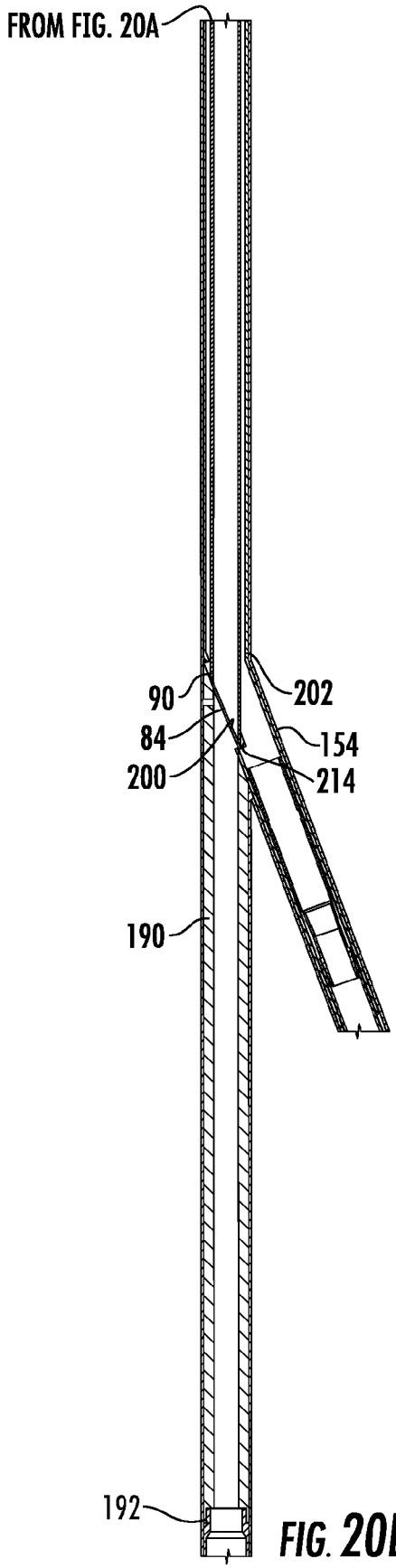

FIG. 20 illustrates window cover 80 being lowered in main bore 150 at the lower end of a tubular string. Window cover 80 may be the same window cover used in FIGS. 10-11 or a duplicate thereof having the same features and dimensions. Alternatively, window cover 80 shown in FIG. 20 may have different features or dimensions than the window cover used in FIGS. 10-11, such as different outer or inner diameters and the presence of opening 92. Upper end 88 of window cover 80 may be attached to connector sub 240, which may be attached to hydraulic packer 242. Hydraulic setting tool 244 may also be included in the tubular string. Window cover 80 may be lowered through main bore 150, central bore 228 of upper junction sub 202, and opening 214 of upper junction sub 202 to position window cover 80 above upper base sub 190 such that tapered lower end surface 84 of window cover 80 engages tapered upper end surface 200 of upper base sub 190. Opening 92 in window cover 80 may engage spring member 51 of spring assembly 45 to align window cover 80 with upper lateral bore 154. Hydraulic packer 242 may then be activated by hydraulic setting tool 244 such that hydraulic packer 242 supports window cover 80 in the above-described position. In this position, window cover 80 may cover window 162 to upper lateral bore 154 and the portion of central bore 228 of upper junction sub 202 extending into upper lateral bore 154. Hydraulic setting tool 244 may then be separated from hydraulic packer 242 and attached window cover 80. The tubular string containing hydraulic setting tool 244 may then be lifted out of main bore 150 leaving window cover 80 and hydraulic packer 242 positioned in central bore 228 of upper junction sub 202 covering window 162 to upper lateral bore 154. Hydraulic packer 242 may be the same as, a duplicate of, or similar to hydraulic packer 234. Alternatively, hydraulic packer 242 may have differing features and/or dimensions from hydraulic packer 234. Hydraulic setting tool 244 may be the same as, a duplicate of, or similar to hydraulic setting tool 235. Alternatively, hydraulic setting tool 244 may have differing features and/or dimensions from hydraulic setting tool 235.

Figure 21A:
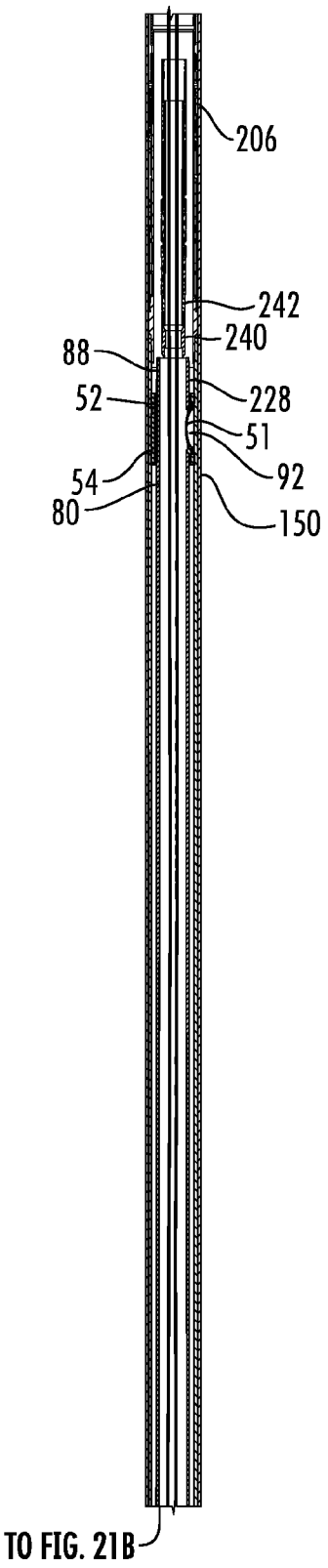
FIG. 21 is a cross-sectional view of the window cover blocking the window to the upper lateral bore as a tool is being lowered through the main bore.
Figure 21B:
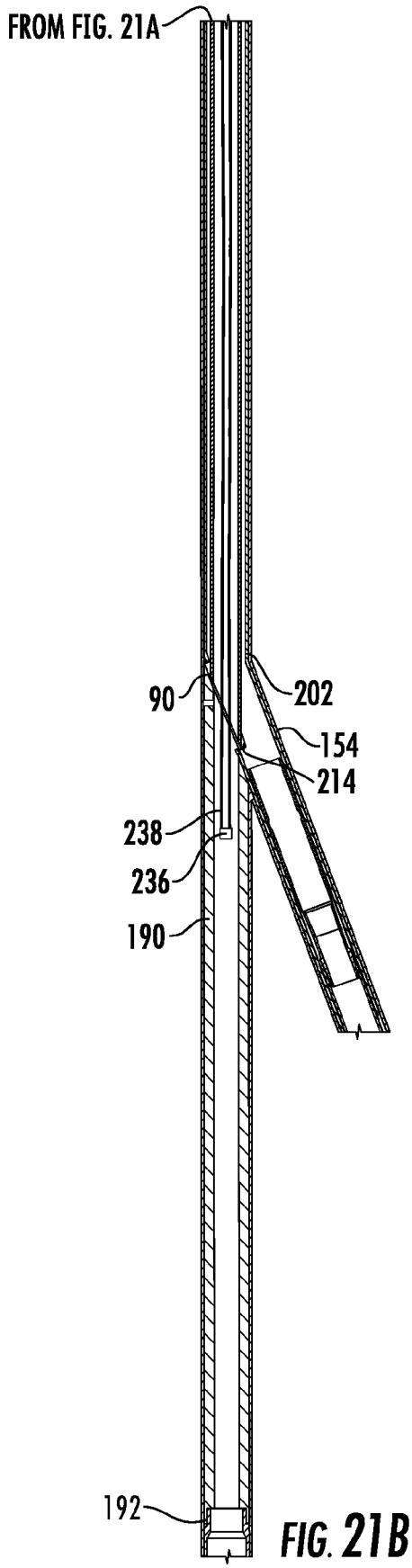

With reference to FIG. 21, tool 236 attached to the end of tubular string 238 may be lowered through main bore 150, through central bore 228 of upper junction sub 202, through central bore 86 of window cover 80, through opening 214 of upper junction sub 202, and into central bore 199 of upper base sub 190. As tool 236 is lowered, it is prevented from entering upper lateral bore 154 by window cover 80. In this way, window cover 80 may direct tool 236 lowered through main bore 150 past upper lateral bore 154 and into main bore 150 below upper base sub 190. Alternatively, window cover 80 may be used to direct a tool lowered through a main bore past a lower lateral bore or the lateral bore in a system having only one lateral bore. If window cover 80 is used to direct a tool lowered through a main bore past a lower lateral bore, there is preferably no base sub positioned in the main bore above the lower lateral bore. Window cover 80 may later be removed to clear central bore 199 of upper base sub 190. Removal of window cover 80 may be accomplished by lowering a retrieval tool to disengage hydraulic packer 242 and to lift hydraulic packer 242 and window cover 80 out of main bore 150.

Figure 22A:
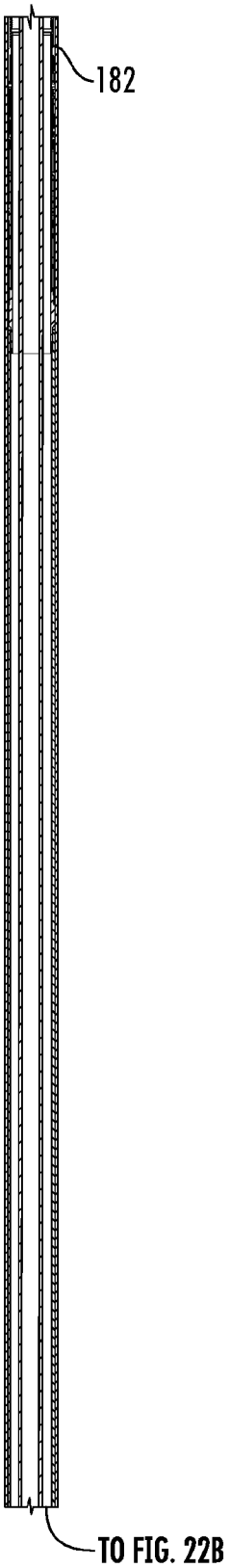
FIG. 22 is a cross-sectional view of the reduction sub directing a tool into the lower lateral bore.
Figure 22B:
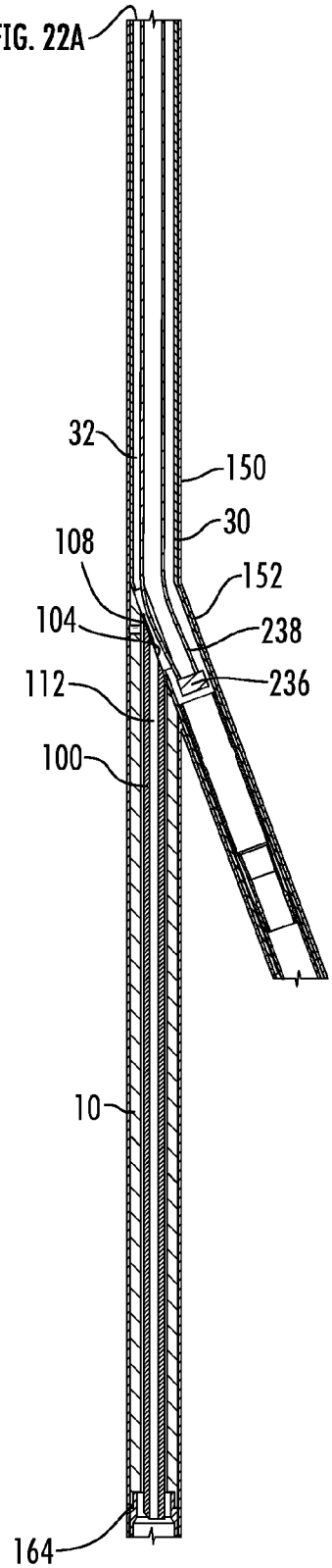

Referring now to FIG. 22, tool 236 may have an outer diameter that is greater than a diameter of central bore 112 of reduction sub 100 that is positioned at lower lateral bore 152. After tool 236 is lowered past upper base sub 190 (as described above and shown in FIG. 21), tool 236 may be lowered through central bore 32 of junction sub 30 and into lower lateral bore 152. As tool 236 encounters ramp 108 and tapered upper end surface 104 of reduction sub 100, ramp 108 may direct tool 236 into lower lateral bore 152 due to the larger outer diameter of tool 236 which will not fit into central bore 112 of reduction sub 100. In this way, reduction sub 100 may direct tool 236 having a larger outer diameter into lower lateral bore 152.

Figure 23A:
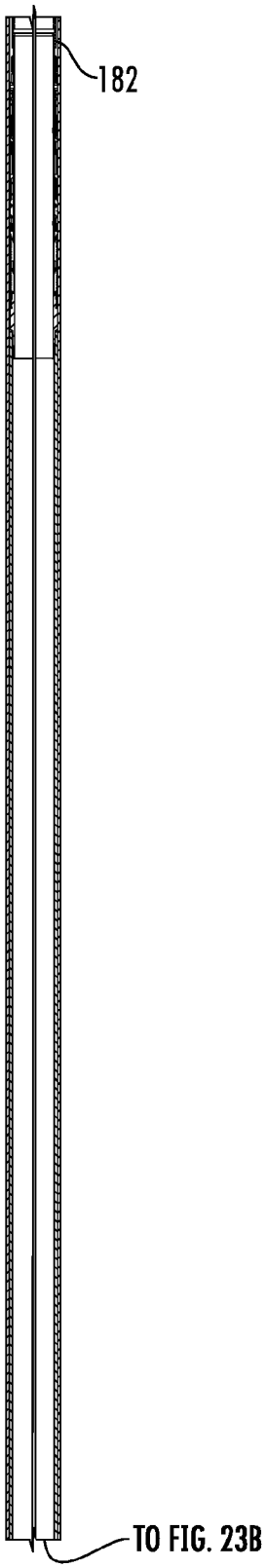
FIG. 23 is a cross-sectional view of a tool being lowered through the main bore and the reduction sub.
Figure 23B:
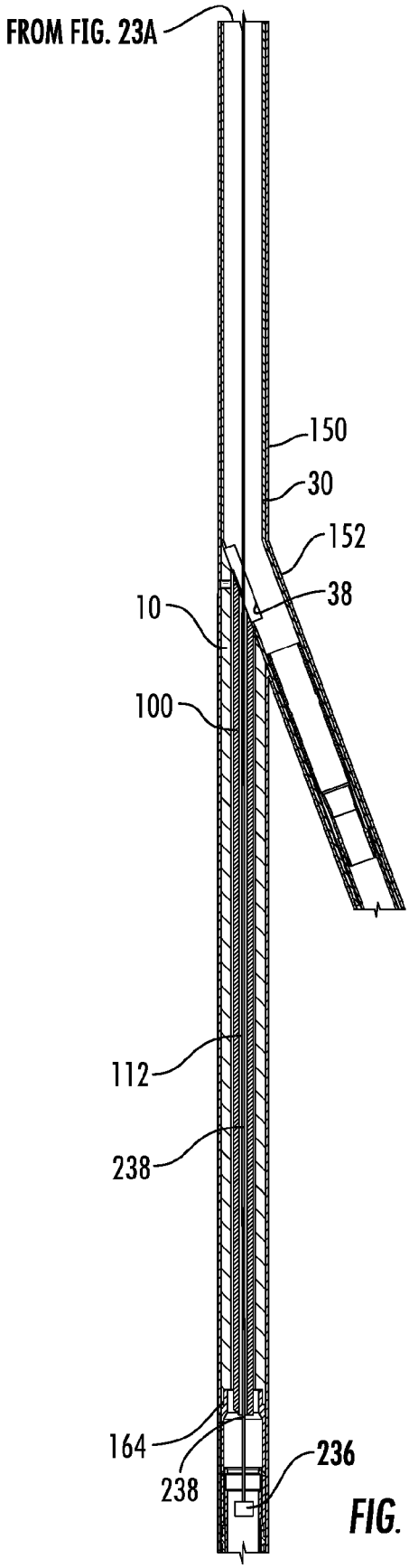

Tool 236 shown in FIG. 23 may have an outer diameter that is smaller than the diameter of central bore 112 of reduction sub 100. After tool 236 is lowered past upper base sub 190 (as described above and shown in FIG. 21), tool 236 may be lowered through central bore 32 and opening 38 of junction sub 30, through central bore 112 of reduction sub 100, and into main bore 150 below base sub 10. Because tool 236 in FIG. 23 has a smaller outer diameter than the diameter of central bore 112 of reduction sub 100, tool 236 fits through central bore 112 of reduction sub 100. In this way, reduction sub 100 may allow tool 236 having a smaller outer diameter to be lowered into main bore 150 below base sub 10. The size of tool 236 may be selected based on its intended target location with respect to lower lateral bore 152, as described above. Specifically, if it is desired to send tool 236 into lower lateral bore 152, a tool having a larger outer diameter than central bore 112 of reduction sub 100 may be selected for use as tool 236. Conversely, if it is desired to send tool 236 into main bore 150 below base sub 10, a tool having a smaller outer diameter than central bore 112 of reduction sub 100 may be selected for use as tool 236. Tool 236 may be a milling apparatus, production equipment, or any other tool that may need to be lowered and selectively directed into upper lateral bore 154, lower lateral bore 152, or the portion of main bore 150 below base sub 10.

The process of selectively directing tool 236 into upper lateral bore 154, lower lateral bore 152, or the portion of main bore 150 below base sub 10 using the lateral liner tie back system as described above in connection with FIGS. 18-23 may be used for a system having main bore 150 and two lateral bores 152 and 154. In an alternative embodiment, the process of selectively directing a tool using the lateral liner tie back system may be employed in a system having only one lateral bore. In this alternative embodiment, diverter sub 120 may be used to direct the tool into the lateral bore, and window cover 80 may be used to prevent the tool from entering the lateral bore and direct the tool into the main bore below the lateral bore.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A lateral liner tie back system comprising:

a junction sub having an outer wall enclosing a central bore, an opening through said outer wall, and a key affixed to said outer wall adjacent to said opening;

a base sub having a central bore extending therethrough and a tapered upper end surface for directing a lower end of said junction sub from a main bore into a lateral bore such that an upper end of an existing liner positioned within said lateral bore is disposed within said central bore of said junction sub, wherein said key of said junction sub is dimensioned to engage said tapered upper end surface of said base sub for aligning said opening of said junction sub with said tapered upper end surface of said base sub; and a tie back sub dimensioned to fit through said central bore of said junction sub, said tie back sub having a first outer wall, a tapered second outer wall, an interconnecting shoulder, a central bore enclosed by said first outer wall and said tapered second outer wall, and a series of threads extending along a circumference of said tapered second outer wall, wherein said series of threads on said tapered second outer wall are dimensioned to engage said upper end of said existing liner positioned within said lateral bore.

2. The system of claim 1, further comprising a window cover having an outer wall enclosing a central bore, said window cover further comprising a tapered lower end surface dimensioned to reciprocally engage said tapered upper end surface of said base sub in order to cover a window of said lateral bore.

3. The system of claim 2, further comprising a spring assembly attached within said central bore of said junction sub, said spring assembly dimensioned to engage an opening through said outer wall of said window cover in order to align said window cover with said lateral bore and said base sub.

4. The system of claim 1, further comprising a diverter sub having a tubular upper portion, a U-shaped middle portion, and a closed lower portion, wherein said tubular upper portion comprises an outer wall enclosing a central bore, and wherein said closed lower portion comprises a ramp for engaging said tapered upper end surface of said base sub and for directing a tool lowered through said central bore of said tubular upper portion of said diverter sub into said lateral bore.

5. The system of claim 4, further comprising a spring assembly attached within said central bore of said junction sub, said spring assembly dimensioned to engage an opening through said outer wall of said tubular upper portion of said diverter sub in order to align said ramp of said diverter sub with said lateral bore and said base sub.

6. The system of claim 1, further comprising a reduction sub dimensioned to fit within said central bore of said base sub; wherein said reduction sub comprises an outer wall enclosing a central bore, a tapered upper end surface, a ramp affixed to said tapered upper end surface for directing a tool from said main bore into said lateral bore, and a key affixed to said outer wall adjacent said tapered upper end surface; and wherein said key is dimensioned to engage said tapered upper end surface of said base sub for aligning said tapered upper end surface of said reduction sub with said tapered upper end surface of said base sub.

7. The system of claim 6, further comprising a window cover having an outer wall enclosing a central bore dimensioned to receive said reduction sub, said window cover further comprising a tapered lower end surface dimensioned to reciprocally engage said tapered upper end surface of said base sub in order to cover a window of said lateral bore to prevent said reduction sub from entering said lateral bore while being lowered into said central bore of said base sub.

8. The system of claim 6, further comprising:

an upper junction sub having an outer wall enclosing a central bore, an opening through said outer wall, and a key affixed to said outer wall adjacent to said opening;

an upper base sub having a central bore extending therethrough and a tapered upper end surface for directing a lower end of said upper junction sub from said main bore into an upper lateral bore such that an upper end of an existing liner positioned within said upper lateral bore is disposed within said central bore of said upper junction sub, wherein said key of said upper junction sub is dimensioned to engage said tapered upper end surface of said upper base sub for aligning said opening of said upper junction sub with said tapered upper end surface of said upper base sub, and wherein said upper lateral bore has a higher elevation than said lateral bore along said main bore;

an upper tie back sub dimensioned to fit through said central bore of said upper junction sub, said upper tie back sub having a first outer wall, a tapered second outer wall, an interconnecting shoulder, a central bore enclosed by said first outer wall and said tapered second outer wall, and a series of threads extending along a circumference of said tapered second outer wall, wherein said series of threads on said tapered second outer wall are dimensioned to engage said upper end of said existing liner positioned within said upper lateral bore.

9. The system of claim 8, further comprising a window cover having an outer wall enclosing a central bore, said window cover further comprising a tapered lower end surface dimensioned to reciprocally engage said tapered upper end surface of said upper base sub in order to cover a window of said upper lateral bore.

10. The system of claim 9, further comprising a spring assembly attached within said central bore of said upper junction sub, said spring assembly dimensioned to engage an opening through said outer wall of said window cover in order to align said window cover with said upper lateral bore and said upper base sub.

11. The system of claim 8, further comprising a diverter sub having a tubular upper portion, a U-shaped middle portion, and a closed lower portion, wherein said tubular upper portion comprises an outer wall enclosing a central bore, and wherein said closed lower portion comprises a ramp for engaging said tapered upper end surface of said upper base sub and for directing a tool lowered through said central bore of said tubular upper portion of said diverter sub into said upper lateral bore.

12. The system of claim 11, further comprising a spring assembly attached within said central bore of said upper junction sub, said spring assembly dimensioned to engage an opening through said outer wall of said tubular upper portion of said diverter sub in order to align said ramp of said diverter sub with said upper lateral bore and said upper base sub.

13. A method for completing an existing liner positioned in a lateral bore, comprising the steps of:

a) providing a lateral liner tie back system comprising: a junction sub having an outer wall enclosing a central bore, an opening through said outer wall, and a key affixed to said outer wall adjacent to said opening; a base sub having a central bore extending therethrough and a tapered upper end surface; and a tie back sub having a first outer wall, a tapered second outer wall, an interconnecting shoulder, a central bore enclosed by said first outer wall and said tapered second outer wall, and a series of threads extending along a circumference of said tapered second outer wall;

b) positioning said base sub within a main bore directly below a window to a lateral bore such that said tapered upper end surface of said base sub is aligned with said lateral bore, wherein said lateral bore connects to said main bore through said window;

c) positioning said junction sub through said window to said lateral bore such that said key of said junction sub engages said tapered upper end surface of said base sub thereby aligning said opening of said junction sub with said tapered upper end surface of said base sub;

d) positioning said tie back sub within said central bore of said junction sub such that said tie back sub is adjacent to an upper end of an existing liner disposed within said lateral bore; and e) engaging said upper end of said existing liner with said series of threads on said tapered second outer wall of said tie back sub.

14. The method of claim 13, wherein step (b) further comprises locating said window to said lateral bore using a lateral bore window locator.

15. The method of claim 14, wherein said lateral bore window locator is capable of locating more than one lateral bore window before being removed from the main bore.

16. The method of claim 13, wherein said junction sub is positioned in step (c) such that said upper end of said existing liner is disposed within said central bore of said junction sub.

17. The method of claim 13, wherein said lateral liner tie back system further comprises a window cover having a tapered lower end surface and an outer wall enclosing a central bore; said method further comprising the steps of:

f) positioning said window cover above said base sub in said main bore such that said tapered lower end surface of said window cover reciprocally engages said tapered upper end surface of said base sub in order to cover said window to said lateral bore;

g) lowering a tool into said main bore, through said central bore of said window cover, through said central bore of said base sub, and into the main bore below said base sub, said window cover preventing said tool from running into said lateral bore.

18. The method of claim 17, wherein said lateral liner tie back system further comprises a spring assembly attached within said central bore of said junction sub, and wherein step (f) further comprises aligning said window cover with said lateral bore and said base sub by engaging said spring assembly with an opening through said outer wall of said window cover.

19. The method of claim 13, wherein said lateral liner tie back system further comprises a diverter sub having a tubular upper portion comprising an outer wall enclosing a central bore, a U-shaped middle portion, and a closed lower portion comprising a ramp; said method further comprising the steps of:

f) positioning said diverter sub within said central bore of said base sub such that said ramp of said closed lower portion of said diverter sub engages said tapered upper end surface of said base sub;

g) lowering a tool into said main bore through said central bore of said tubular upper portion of said diverter sub, and directing said tool into said lateral bore with said ramp of said closed lower portion of said diverter sub.

20. The method of claim 19, wherein said lateral liner tie back system further comprises a spring assembly attached within said central bore of said junction sub, and wherein step (f) further comprises aligning said diverter sub with said lateral bore and said base sub by engaging said spring assembly with an opening through said outer wall of said tubular upper portion of said diverter sub.

21. The method of claim 13, wherein said lateral liner tie back system further comprises a reduction sub having an outer wall enclosing a central bore, a tapered upper end surface, a ramp affixed to said tapered upper end surface, and a key affixed to said outer wall adjacent said tapered upper end surface; said method further comprising the step of:

b1) positioning said reduction sub within said central bore of said base sub such that said key of said reduction sub is engaged with said tapered upper end surface of said base sub thereby aligning said tapered upper end surface of said reduction sub with said tapered upper end surface of said base sub;

and wherein in step (c) said key of said junction sub engages said key of said reduction sub thereby aligning said opening of said junction sub with said tapered upper end surface of said base sub and said tapered upper end surface of said reduction sub.

22. The method of claim 21, wherein said lateral liner tie back system further comprises a window cover having a tapered lower end surface and an outer wall enclosing a central bore; and wherein step (b1) further comprises: positioning said window cover above said base sub in said main bore such that said tapered lower end surface of said window cover reciprocally engages said tapered upper end surface of said base sub in order to cover said window to said lateral bore, thereby preventing said reduction sub from running into said lateral bore such that said reduction sub is positioned within said central bore of said base sub.

23. The method of claim 21, further comprising the steps of:

f) lowering a tool into said main bore, said tool having an outer dimension larger than an inner diameter of said central bore of said reduction sub;

g) directing said tool into said lateral bore with said ramp and said tapered upper end surface of said reduction sub, said reduction sub preventing said tool from being lowered through said central bore of said reduction sub and into the main bore below said base sub and said reduction sub.

24. The method of claim 21, further comprising the steps of:

f) lowering a tool into said main bore, said tool having an outer dimension smaller than an inner diameter of said central bore of said reduction sub;

g) lowering said tool through said central bore of said reduction sub and into the main bore below said base sub and said reduction sub.

* * * * *